US012446645B2

(12) United States Patent
Goldblatt et al.

(10) Patent No.: US 12,446,645 B2
(45) Date of Patent: Oct. 21, 2025

(54) HEAD COVERING

(71) Applicant: Aqua Seco LLC, New York, NY (US)

(72) Inventors: Eileen W. Goldblatt, New York, NY (US); Beth J. Polish, New York, NY (US)

(73) Assignee: AQUA SECO LLC, New York, NY (US)

( * ) Notice: Subject to any disclaimer, the term of this patent is extended or adjusted under 35 U.S.C. 154(b) by 0 days.

(21) Appl. No.: 17/821,578

(22) Filed: Aug. 23, 2022

(65) Prior Publication Data

US 2023/0248100 A1 Aug. 10, 2023

Related U.S. Application Data

(60) Provisional application No. 63/308,311, filed on Feb. 9, 2022.

(51) Int. Cl.
*A42B 1/04* (2021.01)

(52) U.S. Cl.
CPC ..... *A42B 1/04* (2013.01)

(58) Field of Classification Search
CPC .... A42B 1/04; A42B 1/12; A42B 1/22; A42B 1/041; A42B 1/004; A42B 1/049
See application file for complete search history.

(56) References Cited

U.S. PATENT DOCUMENTS 238,878 A * 3/1881 Finster et al. ..... A42B 1/06 2/172
271,529 A * 1/1883 Snow ..... A42B 1/012 2/200.2
324,073 A * 8/1885 Baruch et al. ..... A42B 1/24 2/195.7

(Continued)

FOREIGN PATENT DOCUMENTS

| | | |
|---|---|---|
| EM | 009107782-0001 | 8/2022 |
| KR | 301093800.0000 | 2/2021 |
| KR | 301183260.0000 | 9/2022 |

OTHER PUBLICATIONS https://snipriphooray.blogspot.com/2017/09/twist-headband.html (Year: 2017).*

(Continued)

*Primary Examiner* — Heather Mangine
*Assistant Examiner* — Raquel M. Weis
(74) *Attorney, Agent, or Firm* — Weaver IP L.L.C.

(57) ABSTRACT

A head covering is described that includes a cap formed from a first stretchable material and shaped to encompass a top of a human head, an elastic band connected to a circumferential rim of the cap, and a headband formed from a second stretchable material and arranged around and connected to a bottom circumferential region of the cap. In certain implementations, the headband is non-detachably or detachably connected to the bottom circumferential region of the cap at attachment points spaced along a top edge of the headband and a bottom edge of the headband, such that a pocket is formed between the headband and the cap. In further accordance with such implementations, spacings between the attachment points along the top edge of the headband form openings that provide access to the pocket, such that a wearer can insert excess material of the cap into the pocket for storage therein.

24 Claims, 9 Drawing Sheets

(56) References Cited

U.S. PATENT DOCUMENTS 424,465 A * 4/1890 Cross ..... A42B 1/22 2/175.3
442,921 A * 12/1890 Stohr ..... A42B 1/0186 2/172
690,345 A * 12/1901 Beehler ..... A42B 1/04 D2/879
713,656 A * 11/1902 Littell ..... A42B 1/12 D2/867
770,338 A * 9/1904 Tooher ..... A42B 1/12 2/68
809,947 A * 1/1906 Herndon ..... A42B 1/12 2/200.2
840,169 A * 1/1907 Stollberg ..... A42B 1/12 2/200.2
917,210 A * 4/1909 Weiner ..... A42B 1/04 2/200.1
946,770 A * 1/1910 Sands ..... A42B 1/12 2/209.12
978,048 A * 12/1910 Monoson ..... A42C 5/02 2/209.12
1,050,310 A * 1/1913 Steinberg et al. ... A42B 1/0186 2/195.6
1,105,400 A * 7/1914 Burke ..... A42B 1/201 2/209.12
1,139,312 A * 5/1915 Rindskopf ..... A42B 1/12 2/68
1,143,341 A * 6/1915 Whittaker ..... A42B 1/12 132/274
1,144,121 A * 6/1915 Guinzburg ..... A42B 1/12 D2/867
1,146,829 A * 7/1915 Winget ..... A42B 1/012 2/195.7
1,153,687 A * 9/1915 Hellinga ..... A42B 1/12 2/68
1,213,571 A * 1/1917 Zuckerman ..... A42B 1/12 D2/866
1,269,594 A * 6/1918 Scherz ..... A42B 1/006 D2/866
1,386,890 A * 8/1921 Matyk ..... G10K 1/062 2/195.7
1,390,628 A * 9/1921 Litchfield ..... A42B 1/12 2/68
1,394,366 A * 10/1921 Sharp ..... A42B 1/041 2/195.7
1,414,558 A * 5/1922 Ensten ..... A42B 1/041 2/172
1,501,591 A * 7/1924 Gage ..... A42B 1/12 2/68
1,504,582 A * 8/1924 Solomon ..... A42B 1/0189 2/181
1,532,193 A * 4/1925 Malloy ..... A42B 1/0186 2/172
1,541,810 A * 6/1925 Hamilton ..... A42B 1/12 D2/867
1,566,663 A * 12/1925 Finkelstein ..... A42B 1/04 2/172
1,569,475 A * 1/1926 Gilson ..... A42B 1/12 2/68
1,569,942 A * 1/1926 Barnhill ..... A42B 1/206 2/195.7
1,598,287 A * 8/1926 Larson ..... A42B 1/041 2/195.7
1,602,889 A * 10/1926 Epstein ..... A42B 1/22 D2/885
1,616,475 A * 2/1927 Tracey ..... A42B 1/203 2/195.7
1,652,723 A * 12/1927 Olden ..... A42B 1/22 2/200.1
1,720,560 A * 7/1929 Lipper ..... A42B 1/041 2/195.8
1,726,270 A * 8/1929 Kantrowitz ..... A42B 1/06 2/195.5
1,749,340 A * 3/1930 Grean ..... A42B 1/041 2/195.7
1,780,887 A * 11/1930 Thornburgh ..... A42B 1/041 2/195.7
1,840,557 A * 1/1932 Beach ..... A42B 1/04 2/200.1
1,864,251 A * 6/1932 Macdonald ..... A42B 1/041 2/63
1,886,992 A * 11/1932 Wagenfeld ..... A42B 1/012 D2/890
1,932,004 A * 10/1933 Wittcoff ..... A42B 1/22 2/181.8
1,971,788 A * 8/1934 Lampe ..... A42B 1/12 2/68
2,051,084 A * 8/1936 Hertz ..... A42B 1/22 D2/890
2,107,951 A * 2/1938 Lipton ..... A42B 1/041 2/171.7
2,211,184 A * 8/1940 Varell ..... A42B 1/041 D2/871
2,229,825 A * 1/1941 Stachel ..... A42B 1/12 D2/867
2,268,422 A * 12/1941 Simpson ..... A42B 1/041 2/204
2,279,867 A * 4/1942 Falk ..... A42B 1/041 132/274
2,336,356 A * 12/1943 Harding ..... A42B 1/041 2/195.7
2,414,665 A * 1/1947 Podolsky ..... A42B 1/041 D2/880
2,417,323 A * 3/1947 Richards ..... A42B 1/12 D2/867
2,470,833 A * 5/1949 Moore ..... A45D 2/46 34/96
2,497,892 A * 2/1950 Klar ..... A42B 1/12 D2/880
2,604,630 A * 7/1952 Waring ..... A42B 1/205 2/209.11
2,653,326 A * 9/1953 Ged ..... A42B 1/041 2/195.7
2,694,204 A * 11/1954 Campbell ..... A42B 1/041 2/174
2,735,110 A * 2/1956 Baker ..... A42B 1/06 2/209.12
2,803,829 A * 8/1957 Tscharner ..... A42B 1/248 D2/866
2,804,695 A * 9/1957 Scott ..... A45D 2/46 34/80
2,869,137 A * 1/1959 Scherz ..... A42B 1/22 2/195.4
2,929,071 A * 3/1960 Sterling ..... A42B 1/12 2/68
3,206,761 A * 9/1965 Melnikoff ..... A42B 1/12 2/171.01
3,213,466 A * 10/1965 Gettinger ..... A42B 1/049 2/171.01
3,370,304 A * 2/1968 Pelletier ..... A42B 1/12 D2/883
3,384,904 A * 5/1968 Hofmann ..... A42B 1/208 2/195.7
3,488,774 A * 1/1970 Abbott ..... A42B 1/12 2/68
3,555,565 A * 1/1971 Zimmon et al. ..... A42B 1/012 2/195.7
3,714,670 A * 2/1973 Pollack ..... A42B 1/12 2/918
4,165,542 A * 8/1979 McLaughlin ..... A42B 1/201 2/175.1
4,378,606 A * 4/1983 Snowden ..... A42B 1/041 2/200.1
4,462,117 A * 7/1984 Brunelle ..... A41D 23/00 2/202
4,599,749 A * 7/1986 Childs ..... A42B 1/041 132/53
4,845,782 A * 7/1989 Gregg ..... A42B 7/00 2/172

(56) References Cited

U.S. PATENT DOCUMENTS 5,161,260 A * 11/1992 Reynolds ..... A42B 1/0186 2/209.13
5,203,358 A * 4/1993 Eytcheson ..... A45D 44/12 132/270
5,351,343 A * 10/1994 Harbison ..... A42B 1/0188 2/172
5,365,613 A * 11/1994 Henegan ..... A42B 1/041 2/174
5,455,970 A * 10/1995 Vance ..... A42B 1/201 2/171.04
5,490,528 A * 2/1996 Day ..... A45D 20/20 2/202
5,548,846 A * 8/1996 Bianchetti ..... A42B 1/0184 2/209.12
5,581,813 A * 12/1996 Henschel ..... A42B 1/248 40/329
5,594,956 A * 1/1997 Barrientos ..... A42B 1/22 2/172
6,079,052 A * 6/2000 Veridiano ..... A42B 1/0182 2/172
6,427,251 B1 * 8/2002 Leach ..... A45D 20/00 2/174
6,484,323 B1 * 11/2002 Pu ..... A42B 1/24 2/171.1
6,560,784 B2 * 5/2003 Hill ..... A42B 1/041 2/204
6,735,783 B2 * 5/2004 Phillips ..... A42B 1/041 2/202
6,738,986 B1 * 5/2004 Martin ..... A42B 1/041 2/207
6,948,189 B2 * 9/2005 Early ..... A42C 5/04 2/209.5
7,003,807 B2 * 2/2006 Takanohashi ..... A45D 2/46 2/174
7,634,819 B2 * 12/2009 Grey ..... A45D 8/36 2/207
D621,139 S * 8/2010 Andreoni ..... D2/880
7,802,317 B2 * 9/2010 Segol ..... A42B 1/203 2/171
7,836,522 B2 * 11/2010 Blecha ..... A42B 1/0184 2/209.12
8,316,466 B2 * 11/2012 Saito ..... A42B 1/041 2/202
8,375,469 B2 * 2/2013 Duwyn-Zylstra ..... A42B 1/206 2/209.12
8,613,114 B1 * 12/2013 Olivares Velasco ..... A41D 31/065 2/171.1
8,914,914 B1 * 12/2014 Blake ..... A42B 1/04 2/175.1
9,084,446 B2 * 7/2015 Ramadan ..... A45D 8/36
9,192,202 B2 * 11/2015 Adkins ..... A42B 1/041
9,192,203 B2 * 11/2015 Perthou ..... A42B 1/041
D756,605 S * 5/2016 Taylor ..... D2/867
D756,610 S * 5/2016 Taylor ..... D2/867
9,398,780 B1 * 7/2016 Matallana ..... A42B 1/12
9,504,362 B1 * 11/2016 Skinner ..... A42B 1/041
9,555,288 B1 * 1/2017 Lucas ..... A63B 33/00
9,578,409 B1 * 2/2017 Crockran, Jr. ..... A42B 1/241
9,585,430 B1 * 3/2017 Singh ..... A42B 1/04
10,021,930 B2 * 7/2018 De Jesu ..... A42B 1/12
10,661,122 B1 * 5/2020 Banks ..... A63B 33/00
D892,445 S * 8/2020 Robinson ..... D2/867
D919,241 S * 5/2021 Brown ..... D2/867
11,019,866 B2 * 6/2021 Reno ..... A41D 23/00
11,051,600 B2 * 7/2021 McKay ..... A45D 20/00
D939,812 S * 1/2022 Thurswell ..... D2/825
11,350,685 B2 * 6/2022 Denu ..... A42B 1/049
D982,284 S * 4/2023 Olabarri ..... D2/880
D987,237 S * 5/2023 Vassell ..... D2/878
D998,287 S * 9/2023 Little ..... D2/880
D1,001,426 S * 10/2023 McCabe ..... D2/881
2002/0104150 A1 * 8/2002 Hill ..... A42B 1/041 2/174
2002/0144334 A1 * 10/2002 Brooks ..... A42B 1/206 2/209.12
2003/0159707 A1 * 8/2003 Di Luca ..... A45D 19/18 132/270
2005/0097656 A1 * 5/2005 Segol ..... A42C 5/04 2/209.7
2008/0016602 A1 * 1/2008 Baldwin ..... A42B 1/241 2/209.12
2009/0089916 A1 * 4/2009 Leftenant ..... A42B 1/041 2/207
2009/0126078 A1 * 5/2009 Rashid ..... A42B 1/045 2/207
2009/0210995 A1 * 8/2009 Kwon ..... A42B 1/245 2/209.13
2010/0252054 A1 * 10/2010 Slatten ..... A61F 5/05891 128/845
2011/0271421 A1 * 11/2011 Vahey ..... A42B 1/04 2/209.13
2012/0030860 A1 * 2/2012 Lovitz ..... A42B 1/004 2/209.13
2013/0185844 A1 * 7/2013 Moore ..... A42B 1/241 2/209.13
2013/0318687 A1 * 12/2013 Bressler ..... A45D 8/34 2/209.13
2014/0101821 A1 * 4/2014 Dammann ..... A42B 1/12 2/171.4
2014/0259265 A1 * 9/2014 Schermerhorn ..... A42B 1/245 2/68
2015/0000002 A1 * 1/2015 Brown ..... A42B 1/12 2/68
2015/0082835 A1 * 3/2015 Xu ..... A42B 1/18 2/200.1
2015/0150327 A1 * 6/2015 Scott ..... A42B 1/12 2/68
2015/0335086 A1 * 11/2015 Murphy ..... A42B 1/041 2/171
2015/0359284 A1 * 12/2015 Watson ..... A42B 1/12 2/174
2016/0100648 A1 * 4/2016 De Jesu ..... A42B 1/12 2/174
2016/0120254 A1 * 5/2016 Montoya ..... A42B 1/22 2/68
2016/0198830 A1 * 7/2016 Tussey ..... A42B 1/049 2/183
2016/0309872 A1 * 10/2016 Domizi ..... A42B 1/225
2017/0027262 A1 * 2/2017 Palmer ..... A42B 1/22
2017/0042267 A1 * 2/2017 Guice ..... A42B 1/12
2017/0258165 A1 * 9/2017 Thornton ..... A42C 5/02
2017/0354195 A1 * 12/2017 Gelberg ..... A42B 1/22
2017/0360138 A1 * 12/2017 Guice ..... A42B 1/206
2018/0027912 A1 * 2/2018 Borrás Esteve ..... A42B 1/12
2019/0000206 A1 * 1/2019 Domizi ..... A42B 1/225
2019/0037944 A1 * 2/2019 Tussey ..... A42B 1/049
2019/0200695 A1 * 7/2019 Adkins ..... A42B 1/22
2019/0313946 A1 * 10/2019 Moore ..... A42B 1/08
2020/0288804 A1 * 9/2020 Westbrook ..... A42B 7/00
2021/0120900 A1 * 4/2021 Stirgus ..... A42B 1/049
2021/0337907 A1 * 11/2021 Bowman ..... A42B 1/04
2021/0401101 A1 * 12/2021 Miller ..... A42B 1/12
2023/0248100 A1 * 8/2023 Goldblatt ..... A42B 1/12 2/209.3

OTHER PUBLICATIONS

"AQUA "Vintage Twist" Turban (Noir)", [online]; [review published to the internet on Apr. 18, 2024]; [retrieved from the internet on Apr. 25, 2025 by the USPTO], URL: https://www.aquaheadwear.com/products/aqua-vintage-twist-turban, 2024, 21 pages.

"Athletic Turban Olive", [online]; [review published to the internet on Apr. 23, 2021]; [retrieved from the internet on Apr. 25, 2025 by the USPTO], URL: https://www.lanuuk.com/products/turban-olive, 2021, 3 pages.

(56) References Cited

OTHER PUBLICATIONS

"Self-tie Turban CLAY", [online]; [review published to the internet on Oct. 10, 2020]; [retrieved from the internet on Apr. 25, 2025 by the USPTO], URL: https://www.lanuuk.com/products/self-tie-turban-clay, 2020, 3 pages.
Non-Final Office Action mailed on May 6, 2025 in Design U.S. Appl. No. 29/868,647, 12 pages.

* cited by examiner

1700

2100

2200A

2200B

HEAD COVERING

CROSS-REFERENCE TO RELATED APPLICATIONS

This application claims priority to U.S. Provisional Patent Application No. 63/308,311, filed Feb. 9, 2022, the entirety of which is incorporated by reference as if fully set forth herein.

BACKGROUND

People who engage in a watersport or other water-related activity (e.g., aqua aerobics, water yoga, wading, paddle boarding, jet skiing, kayaking, rafting, tubing, water-based running/cycling, taking a shower or bath, using a hot tub, lounging by a pool, lake or on the beach, or even kiddy pool chaperoning) may wish to wear a head covering to contain their hair and keep it dry, to prevent their hair from encumbering them while engaging in such an activity, to protect their hair from chlorine and other chemical damage, to protect their hair from the sun or sun damage, to facilitate an easy and efficient transition from the water to everyday terrain and activities, and/or to comply with a head covering requirement of a pool or other facility. Unfortunately, conventional head coverings for watersports or other water-related activities suffer from a number of drawbacks. Two such conventional head coverings—namely, shower caps and swim caps—will now be discussed.

Shower caps may be unsuitable for watersports or other water-related activities for a number of reasons. For instance, shower caps typically include only a single band of elastic for maintaining attachment to the head. The single elastic band may be too loose, in which case the shower cap will not remain on the wearer's head for very long, or too tight, in which case the band may cut into the wearer's head, causing discomfort. Furthermore, even if the fit is tight, the single elastic band may be grossly insufficient to ensure the shower cap remains in place during activities in which the wearer's head is often in motion or in which there is water or wind impact. Shower caps also typically include a cap portion that is baggy and oversized relative to the head to accommodate different volumes and styles of hair. Besides being unattractive, such baggy cap portion can be an annoyance and/or encumbrance during aquatic activities, as the excess cap material can create increased friction between the wearer's head and surrounding air/water. Finally, shower caps are typically made of plastic which is not breathable, and which can lead to sweating that disrupts hairstyles.

Swim caps are better suited for watersports than shower caps because they are designed to be more form fitting to the head. However, this tight-to-the-head fit can cause hair breakage or other damage to hair and hair dos/styling. Additionally, some swim caps can expose the hairline, which may also lead to hair damage and/or ruining of hair styles. Also, because swim caps are typically tight-fitting across the entire head, they can be hot (which may cause the wearer to sweat), uncomfortable, and/or cause pressure headaches. Many swim cap designs hold ears down in awkward and uncomfortable positions. In sum, conventional swim caps, which are primarily designed for competitive swimming, may not only underdeliver in terms of comfort and general protection, but can actually be an active cause of damage to the wearer and his or hair and/or hair style.

Furthermore, the possibility of hair damage, unkempt strands of hair, knots, and/or the like are not just poolside or post-workout inconveniences. Wind, rain, and wind-blown materials (e.g., sand, dirt, and/or debris in the air due to weather), as well as pollutants, chemicals, and/or the like can compromise the longevity and overall health of hair, including hair stylings such as an updo, curl, or blowout. Accessories like umbrellas and hoods, while often not as restrictive as shower caps or swim caps, can be inadequate to protect hair from inclement weather and other environmental hazards, as they do not create a sufficient barrier against moisture in the air, gusts of wind, and/or the like. Such accessories are also not practical for pool activities.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A head covering is described herein that includes a cap formed from a first stretchable material and shaped to encompass a top of a human head, an elastic band connected to a circumferential rim of the cap, and a headband formed from a second stretchable material and arranged around and connected to a bottom circumferential region of the cap.

In an implementation, the headband is connected to the bottom circumferential region of the cap at attachment points spaced along a top edge of the headband and a bottom edge of the headband, such that a pocket is formed between the headband and the cap. In further accordance with such an implementation, spacings between the attachment points along the top edge of the headband form openings that provide access to the pocket, such that a wearer can insert excess material of the cap into the pocket for storage therein.

In another implementation of the head covering, the headband is non-detachably affixed to the bottom circumferential region of the cap. For example, the headband may be non-detachably affixed to the bottom circumferential region of the cap by one or more of stitches of thread, tacks, rivets, clamps, or an adhesive.

In yet another implementation of the head covering, the headband is removably attachable to the bottom circumferential region of the cap via one or more detachable fasteners. For example, the headband may be removably attached to the bottom circumferential region of the cap by one or more of buttons, snaps, clips, hook and eye material, or magnets.

In still another implementation of the head covering, at least one of the first stretchable material or the second stretchable material is a four-way stretchable material.

In a further implementation of the head covering, at least one of the first stretchable material or the second stretchable material is a water-resistant material.

In a still further implementation of the head covering, at least one of the first stretchable material or the second stretchable material is a breathable material.

In a yet further implementation of the head covering, at least one of the first stretchable material or the second stretchable material is an ultraviolet (UV) resistant material.

In another implementation of the head covering, the cap further include pleats, wherein each of the pleats is formed by stitching a fold in the first stretchable material at a respective point proximate to the circumferential rim of the cap and wherein each of the pleats extends from the circumferential rim of the cap toward a top of the cap. In further accordance with such an implementation, pleats may be present on a front side of the cap, a back side of the cap, a left side of the cap, and a right side of the cap. In one implementation, a total number of pleats on the back side of the cap exceeds each of a total number of pleats on the front side of the cap, a total number of pleats on the left side of the cap, and a total number of pleats on the right side of the cap.

In still further accordance with an implementation of the head covering that includes a pleated cap, each pleat may be formed such that it extends through one of the spacings between the attachment points along the top edge of the headband at a point that is closer to one of the attachment points that forms the spacing than to a center of the spacing.

In yet another implementation of the head covering, the headband is formed from a single piece of the second stretchable material by (a) folding the piece of the second stretchable material to form an elongated piece, (b) forming a first loop by folding a first end of the elongated piece substantially to a center of an inner side of the elongated piece, (c) forming a second loop by folding a second end of the elongated piece through the first loop and substantially to the center of the inner side of the elongated piece, and (d) coupling the first and second ends to one another and to the center of the inner side of the elongated piece.

Further features and advantages of the invention, as well as the structure and operation of various implementations of the invention, are described in detail below with reference to the accompanying drawings. It is noted that the invention is not limited to the specific implementations described herein. Such implementations are presented herein for illustrative purposes only. Additional implementations will be apparent to persons skilled in the relevant art(s) based on the teachings contained herein

BRIEF DESCRIPTION OF THE DRAWINGS/FIGURES

The accompanying drawings, which are incorporated herein and form part of the specification, illustrate embodiments of the application and, together with the description, further serve to explain the principles of the embodiment and to enable a person skilled in the relevant art(s) to make and use the embodiments.

Figure 1:
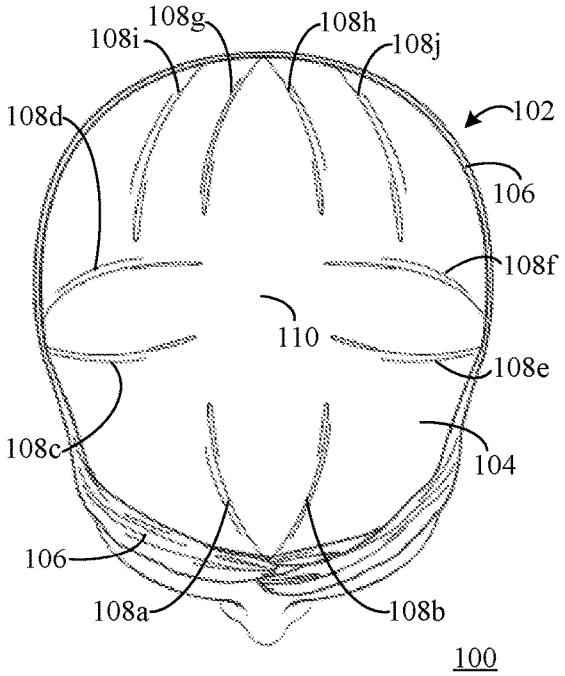
FIG. 1 shows a top perspective view of a head covering in accordance with an example implementation.
Figure 2:
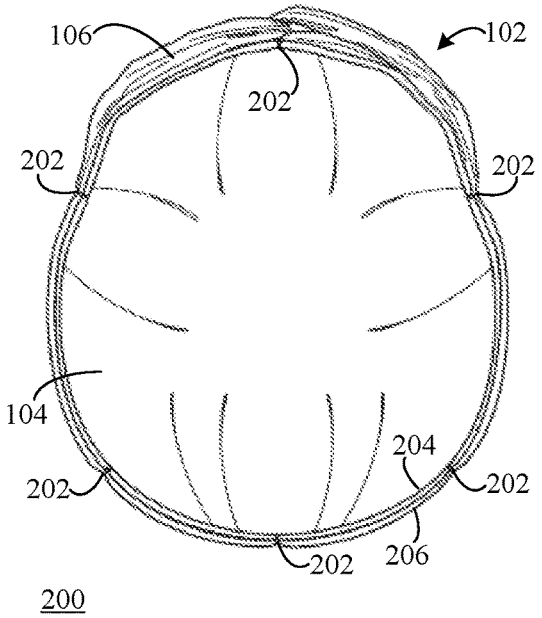
FIG. 2 shows a bottom perspective view of the head covering of FIG. 1.
Figure 3:
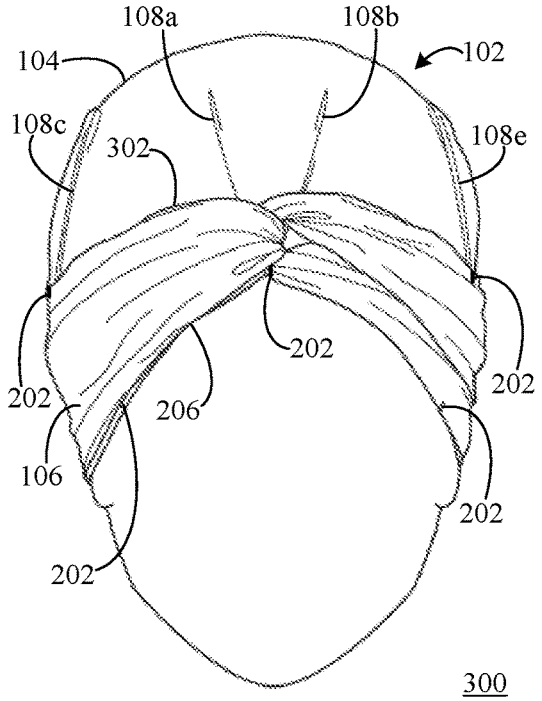
FIG. 3 shows a front perspective view of the head covering of FIG. 1.
Figure 4:
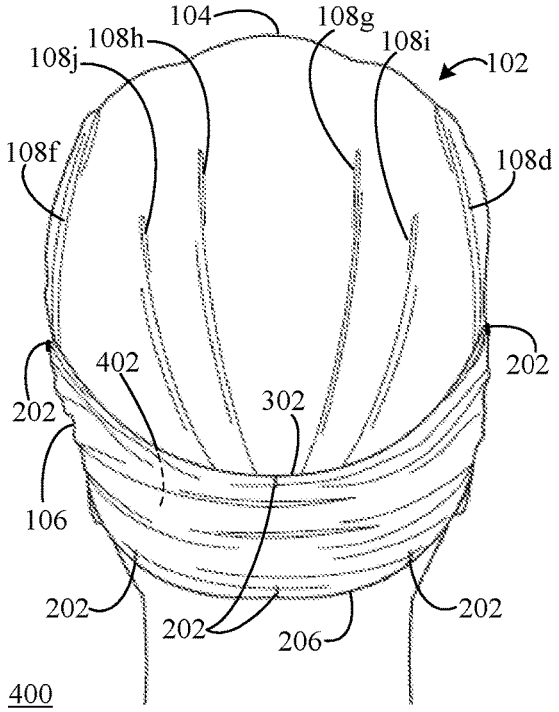
FIG. 4 shows a back perspective view of the head covering of FIG. 1.

FIGS. 9-14 each show a perspective view of, and demonstrate assembly of, the headband of the head covering of FIG. 1.

Figure 15:
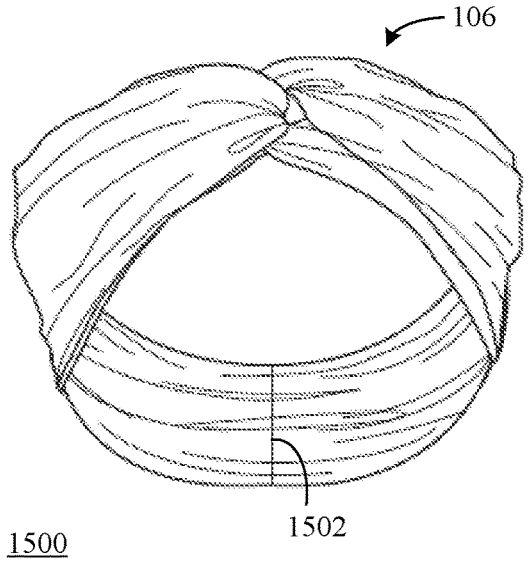

FIG. 15 shows a lower-front perspective view of the headband of the head covering of FIG. 1.

Figure 16:
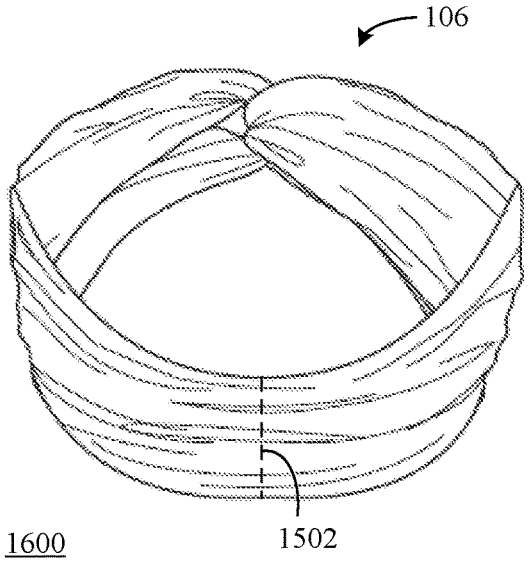

FIG. 16 shows an upper-back perspective view of the headband of the head covering of FIG. 1.

Figure 17:
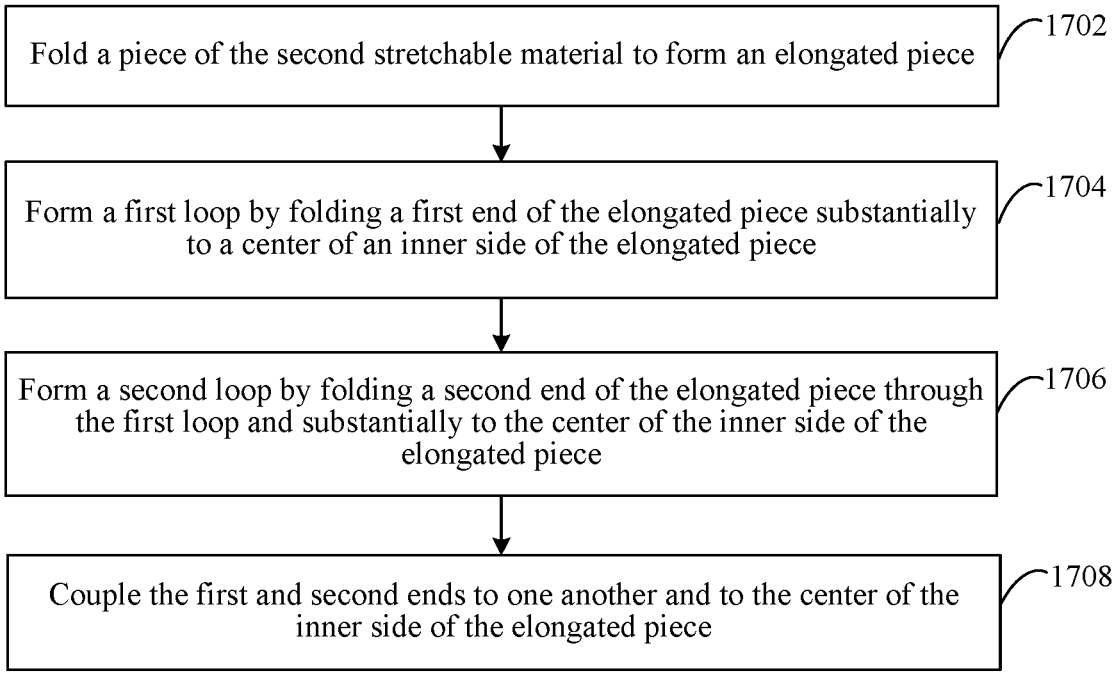

FIG. 17 shows a flowchart of a method of assembling the headband of the head covering of FIG. 1 in accordance with an example implementation.

Figure 18:
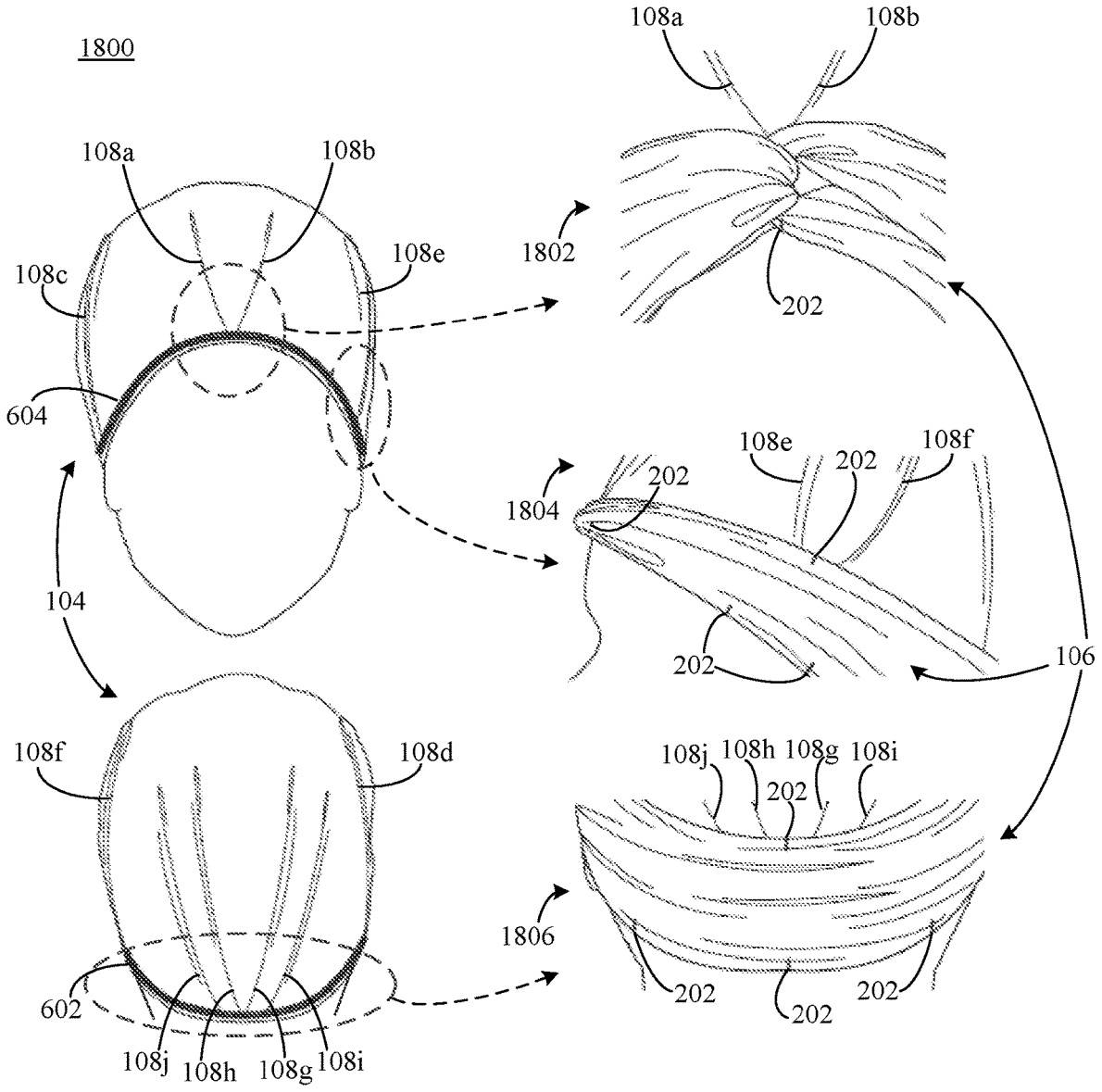

FIG. 18 shows attachment configurations in a front perspective view and a back perspective of the cap of the head covering of FIG. 1 with respect to the headband of the head covering of FIG. 1.

Figure 19:
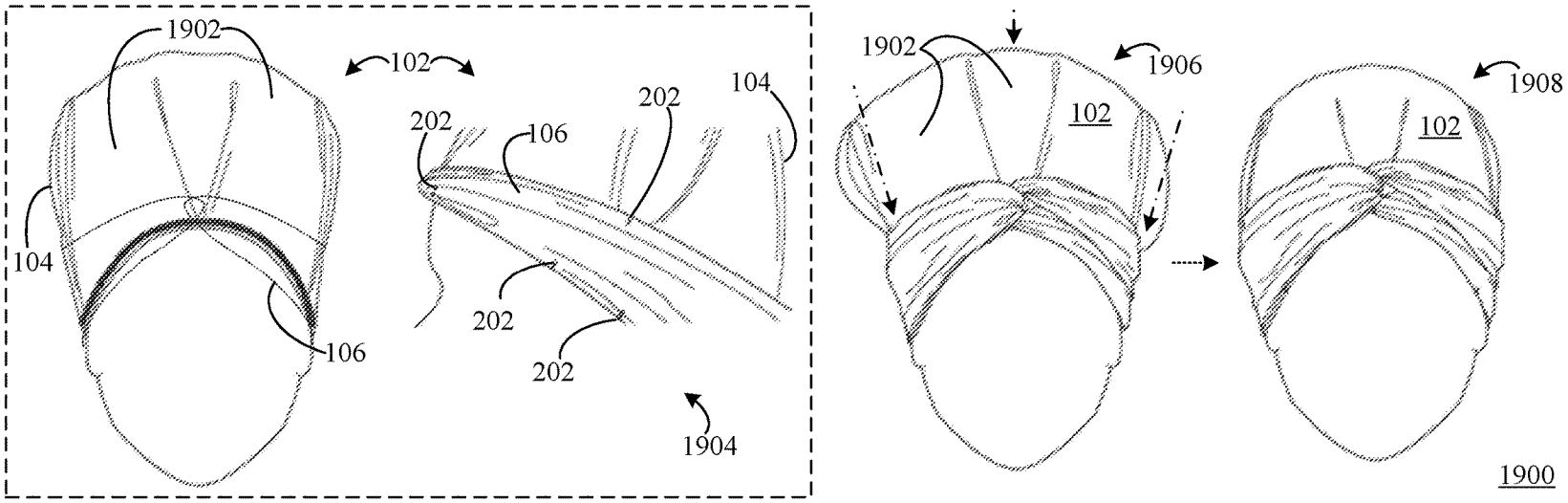

FIG. 19 shows a multi-perspective view of the head covering of FIG. 1 with tucking of excess cap material.

Figure 20:
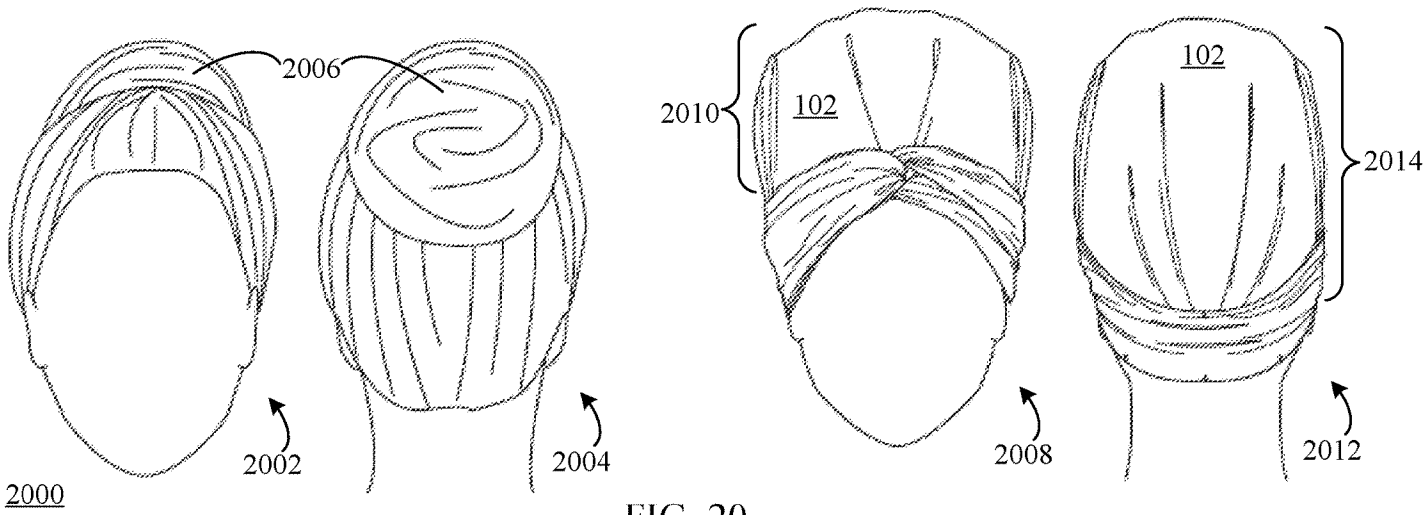

FIG. 20 shows a multi-perspective view of the head covering of FIG. 1 with tucking of excess cap material for a wearer with large hair volume.

Figure 21:
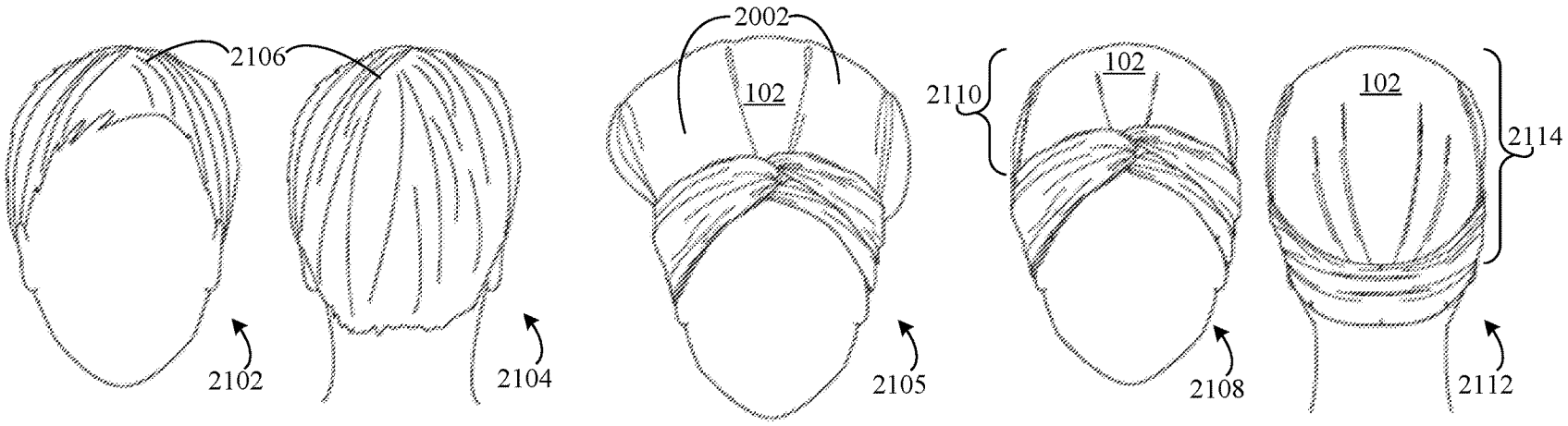

FIG. 21 shows a multi-perspective view of the head covering of FIG. 1 with tucking of excess cap material for a wearer with small hair volume.

Figure 22A:
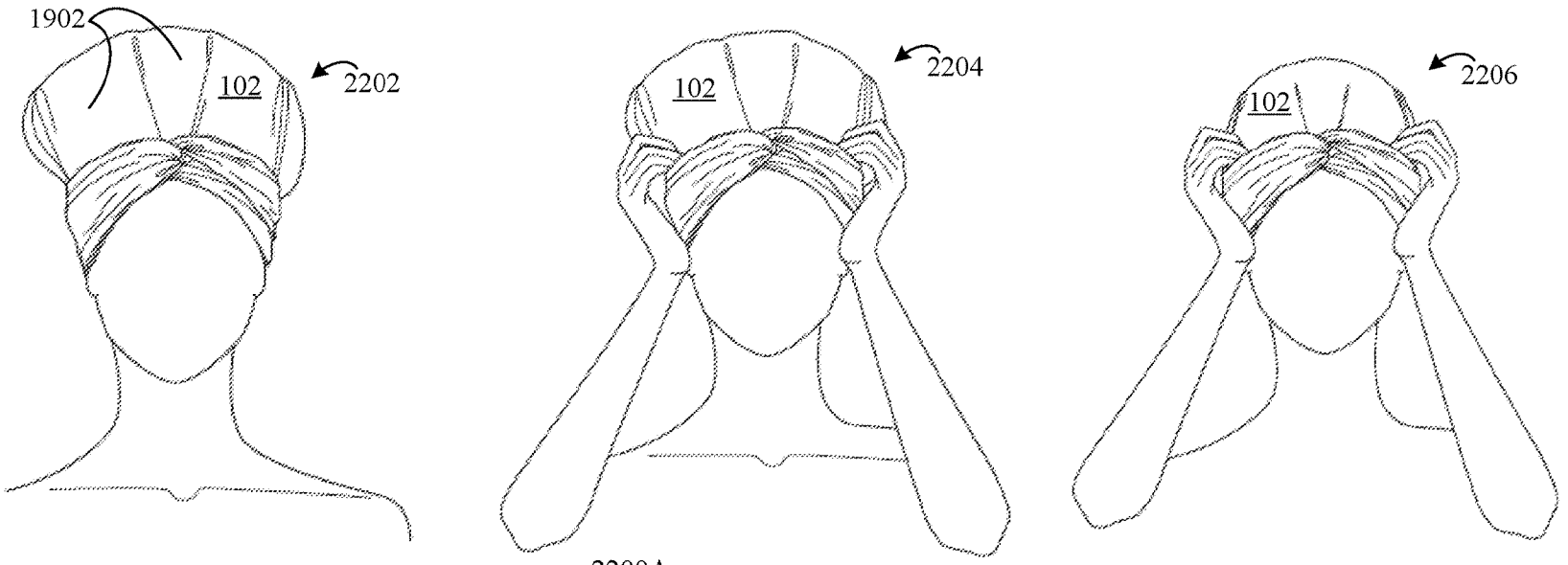

FIG. 22A shows a single-perspective view of the head covering of FIG. 1 with tucking of excess cap material by a wearer.

Figure 22B:
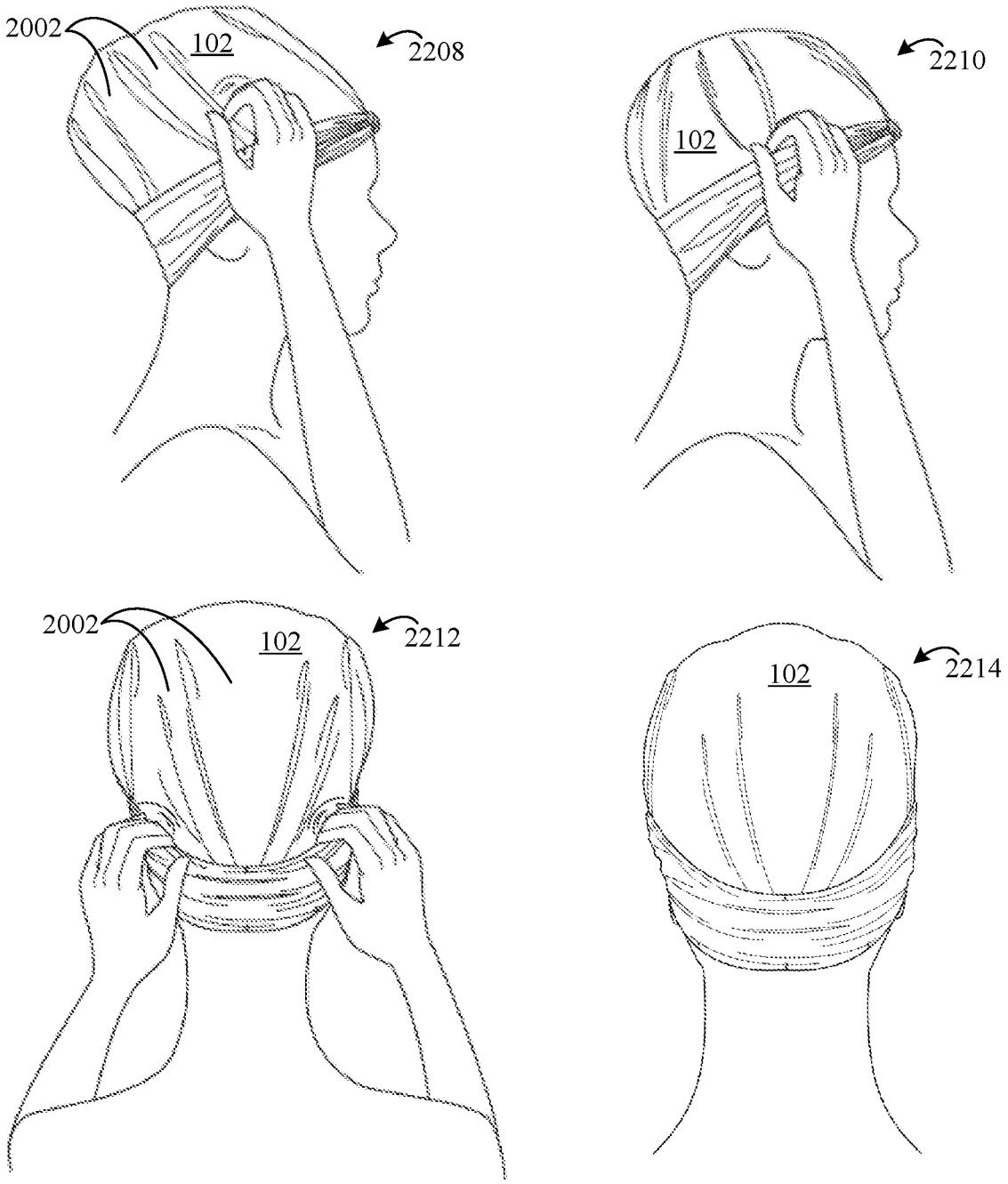

FIG. 22B shows a multi-perspective view of the head covering of FIG. 1 with tucking of excess cap material by a wearer.

The features and advantages of the embodiments described herein will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

I. Introduction

The following detailed description discloses numerous example embodiments. The scope of the present patent application is not limited to the disclosed embodiments but also encompasses combinations of the disclosed embodiments, as well as modifications to the disclosed embodiments.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of persons skilled in the relevant art(s) to implement such feature, structure, or characteristic in connection with other embodiments whether or not explicitly described.

In the discussion, unless otherwise stated, adjectives such as "substantially," "approximately," and "about" modifying a condition or relationship characteristic of a feature or features of an embodiment of the disclosure, are understood to mean that the condition or characteristic is defined to be within tolerances that are acceptable for operation of the embodiment for an application for which it is intended.

If the performance of an operation is described herein as being "based on" one or more factors, it is to be understood that the performance of the operation may be based solely on such factor(s) or may be based on such factor(s) along with one or more additional factors. Thus, as used herein, the term "based on" should be understood to be equivalent to the term "based at least on."

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures and drawings described herein can be spatially arranged in any orientation or manner. Additionally, the drawings may not be provided to scale, and orientations or organization of elements of the drawings may vary in embodiments.

Numerous exemplary embodiments are described as follows. It is noted that any section/subsection headings provided herein are not intended to be limiting. Embodiments are described throughout this document, and any type of embodiment may be included under any section/subsection. Furthermore, embodiments disclosed in any section/subsection may be combined with any other embodiments described in the same section/subsection and/or a different section/subsection in any manner.

II. Example Head Covering Embodiments

A head covering will now be described that addresses one or more of the drawbacks of conventional head coverings as discussed in the Background Section. Certain features of the head covering, and of various implementations thereof, will first be described in a general manner (without the aid of figures) and relative benefits of those features as compared to conventional head coverings will also be set forth. Following this introduction, a more detailed explanation of the head covering, and of various implementations thereof, will be provided in reference to FIGS. 1-21, 22A and 22B.

As will be discussed in more detail herein, the head covering includes a cap formed from a first stretchable material and shaped to encompass a top of a human head, an elastic band connected to a circumferential rim of the cap, and a headband formed from a second stretchable material and arranged around and connected to a bottom circumferential region of the cap. This design is beneficial because the stretchable nature of the cap, the elastic band, and the headband all operate together to provide a secure and stable attachment of the head covering to the head of the wearer. Such attachment can be more secure than that provided by a typical shower cap that relies on only a single elastic band for attachment to the wearer. Furthermore, in accordance with this design, the attachment force is distributed over a wider surface area of the wearer's head as compared to a typical shower cap in which it is concentrated in the single elastic band. Thus, the elastic band of the present design need not be overly tight, which means that discomfort can be avoided.

In one implementation of the head covering, the headband is connected to the bottom circumferential region of the cap at attachment points spaced along a top edge of the headband and a bottom edge of the headband, such that a pocket is formed between the headband and the cap. In further accordance with this implementation, spacings between the attachment points along the top edge of the headband form openings that provide access to the pocket, such that a wearer can insert excess material of the cap into the pocket for storage therein. Thus, the cap can be formed of sufficient material to fully encompass long, voluminous hair and hair dos, but for wearers that do not require so much material (e.g., wearers with relatively short hair), any excess material of the cap can be tucked into the pocket, thus giving the cap a more streamlined and shape-conforming appearance. In addition to providing a neater and more aesthetically-pleasing look, this feature can be utilized to reduce the exposed surface area of the cap thereby reducing friction between the wearer's head and surrounding air/water. This feature can also be leveraged to smooth out folds in the cap within which water, dirt, or other materials might otherwise collect.

In another implementation of the head covering, the headband is non-detachably affixed to the bottom circumferential region of the cap. For example, the headband may be non-detachably affixed to the bottom circumferential region of the cap by one or more of stitches of thread, tacks, rivets, clamps, or an adhesive. Such an integrated design requires no assembly of the head covering by the wearer.

In yet another implementation of the head covering, the headband is removably attachable to the bottom circumferential region of the cap via one or more detachable fasteners. For example, the headband may be removably attached to the bottom circumferential region of the cap by one or more of buttons, snaps, clips, hook and eye material, or magnets. The use of one or more detachable fasteners to connect the headband to the cap may facilitate easy replacement of worn, damaged, or soiled cap and headband components, the selection of different size and fit options, the selection of different material options for different environments or situations, and/or the like, in addition to providing the wearer with options for mixing and matching prints, colors, etc., of head covering materials. It is noted that the headband may be removably attachable to the bottom circumferential region of the cap without using any detachable fasteners. For example, in an embodiment, the attachment is achieved by the contraction of the stretched material of the headband against the cap and head of the wearer.

In still another implementation of the head covering, at least one of the first stretchable material or the second stretchable material is a four-way stretchable material. The use of a four-way stretchable material beneficially enables the cap and/or headband to better encapsulate a variety of different head shapes, hair lengths/volumes, and/or hairdo shapes by permitting "give" in four different directions.

In a further implementation of the head covering, at least one of the first stretchable material or the second stretchable material is a water-resistant material. The use of a water-resistant material advantageously serves to protect the wearer's head and hair from water or moisture, which is particularly useful when engaging in watersports or other water-related activities. Furthermore, water-resistant materials that are soft, light and comfortable to wear are generally available at relatively low cost and may present a better design option than certain types of waterproof materials such as plastic and silicon that may have little or no stretch, can feel tight and irritate the scalp, and are not breathable which can lead to heat, discomfort, and/or sweating that disrupts hairstyles.

In a still further implementation of the head covering, at least one of the first stretchable material or the second stretchable material is a breathable material. Breathable materials beneficially allow air to flow through them easily. Consequently, the use of such materials to implement the head covering helps to ensure that the head covering will not become too warm or uncomfortable. Furthermore, such materials can speed up sweat evaporation and thus keep the wearer comfortable and dry even when sweating.

In a yet further implementation of the head covering, at least one of the first stretchable material or the second stretchable material is an ultraviolet (UV) resistant material. The use of a UV-resistant material for the cap and/or headband can beneficially protect the wearer's head from harmful UV rays that can cause sunburn, early skin aging, and skin cancer. Furthermore, UV-resistant materials have been shown to better withstand the degradation and fading that can be caused by exposure to UV rays.

In another implementation of the head covering, the cap further include pleats, wherein each of the pleats is formed by stitching a fold in the first stretchable material at a respective point proximate to the circumferential rim of the cap and wherein each of the pleats extends from the circumferential rim of the cap toward a top of the cap. The inclusion of pleats helps provide extra volume in the cap when needed to accommodate larger volumes of hair or hair dos, while also providing a streamlined appearance when such volume is not needed.

In further accordance with such an implementation, pleats may be present on a front side of the cap, a back side of the cap, a left side of the cap, and a right side of the cap, thus providing additional volume, if needed, on all sides of the cap. This helps facilitate a "one size fits most" aspect of the head covering. In one implementation, a total number of pleats on the back side of the cap exceeds each of a total number of pleats on the front side of the cap, a total number of pleats on the left side of the cap, and a total number of pleats on the right side of the cap. Such a design is premised on the observation that many or even most long hairstyles are characterized by greater hair volume at the back of the head than on any other side of the head. By providing more pleats on the back of the cap than on any other side, an implementation of the head covering advantageously implements pleats where they are likely to be needed most, while permitting a simpler design (e.g., fewer pleats) on the sides of the cap where pleats are less likely to be needed.

In still further accordance with an implementation of the head covering that includes a pleated cap, each pleat may be formed such that it extends through one of the spacings between the attachment points along the top edge of the headband at a point that is closer to one of the attachment points that forms the spacing than to a center of the spacing. Such a configuration helps ensure that excess pleat material that is tucked into the pocket will be tucked in closer to an attachment point, where the clamping force of the pocket is expected to be greater, rather than to a midpoint between attachment points, where the clamping force of the pocket is expected to be less. This helps ensure that tucked in pleat material remains tucked in while the head covering is being worn.

In yet another implementation of the head covering, the headband is formed from a single piece of the second stretchable material by (a) folding the piece of the second stretchable material to form an elongated piece, (b) forming a first loop by folding a first end of the elongated piece substantially to a center of an inner side of the elongated piece, (c) forming a second loop by folding a second end of the elongated piece through the first loop and substantially to the center of the inner side of the elongated piece, and (d) coupling the first and second ends to one another and to the center of the inner side of the elongated piece. This design has a number of benefits, including but not limited to: forming the headband with two layers of the second stretchable material, which increases its attachment strength and durability (essentially making it a 2-ply headband), ensuring that only a single stitched seam is required to hold the headband together, and ensuring that such single stitched seam is located on an inner side of the headband where it is better protected from wear and tear. Note that in a further implementation, the elongated piece itself is formed by folding a larger piece of the second stretch material in half lengthwise, thus making the headband a 4-ply headband.

Particular implementations of the head covering are very useful in protecting hair from water (e.g., chlorinated water), moisture, splashing and humidity during water activities such as but not limited to aqua aerobics. The aforementioned cap and headband combination can help save a wearer's hair from a harsh experience in a manner that is aesthetically pleasing and that can conform with pool rules regarding what is and isn't an appropriate head covering.

For example, the part of the head that often takes the brunt of the water in an aqua aerobics class or helping children as they splash in a pool or relaxing in a hot tub is the 2-3 inch rim around the face and hair line. In accordance with certain implementations described herein, the hairband is approximately 2-3 inches wide at all points, even at the front knot (as will be described herein in reference to at least FIGS. 3 and 4). The headband itself can thus act as armor against splashes and humidity. Furthermore, in accordance with certain implementations, this protection can be achieved through multiple layers of water-resistant material. For example, in an implementation described herein the headband itself comprises a folded portion of water-resistant material (as will be described herein in reference to at least FIGS. 9-14), accounting for two layers of protection, and is doubled around itself at the front (as will be described herein in reference to at least FIGS. 15 and 16), thereby producing four layers of protection. Because this headband is attached to the cap which itself can comprise a water-resistant material, five layers of protection are provided. Finally, because the cap may include an elastic material around the rim thereof, six layers of protection may be provided to the aforementioned 2-3 inch rim around the face and hair line.

Various implementations of a head covering that provides one or more of the foregoing features and benefits will now be described in reference to FIGS. 1-21, 22A and 22B.

FIGS. 1-5 show a top perspective view 100, a bottom perspective view 200, a front perspective view 300, a back perspective view 400, and a right-profile perspective view 500, respectively, of a head covering 102 in accordance with an example implementation. Head covering 102 includes a cap 104 formed from a first stretchable material and shaped to encompass a top of a human head, an elastic band 602 (not visible in FIGS. 1-4, but shown in FIG. 6) that is connected to a circumferential rim 204 (or bottom edge) of cap 104, and a headband 106 that is formed from a second stretchable material and arranged around a bottom circumferential region of cap 104. As noted above, this design is beneficial because the stretchable nature of cap 104, elastic band 602, and headband 106 all operate together to provide a secure and stable attachment of head covering 102 to the head of the wearer. Such attachment can be more secure than that provided by a typical shower cap that relies on only a single elastic band for attachment to the wearer. Furthermore, in accordance with this design, the attachment force is distributed over a wider surface area of the wearer's head as compared to a typical shower cap in which it is concentrated in the single elastic band. Thus, elastic band 602 of the present design need not be overly tight, which means that discomfort can be avoided.

Headband 106 is connected to the bottom circumferential region of cap 104 at attachment points 202 spaced along a top edge 302 of headband 106 and a bottom edge 206 of headband 106, such that a pocket 402 is formed between headband 106 and cap 104. Pocket 402 may circumscribe, or approximately circumscribe, cap 104 underneath headband 406. That is, pocket 402 is bounded by the interior portion of headband 106 and the covered region on the outside portion of cap 104. In further accordance with this implementation, spacings between attachment points 202 along top edge 302 of headband 106 form openings that provide access to pocket 402, such that a wearer can insert excess material of cap 104 into pocket 402 for storage therein. Thus, cap 104 can be formed of sufficient material to fully encompass long, voluminous hair and hair dos, but for wearers that do not require so much material (e.g., wearers with relatively short hair), any excess material of cap 104 can be tucked into pocket 402, thus giving cap 104 a more streamlined and shape-conforming appearance. In addition to providing a neater and more aesthetically-pleasing look, this feature can be utilized to reduce the exposed surface area of cap 104 thereby reducing friction between the wearer's head and surrounding air/water. This feature can also be leveraged to smooth out folds in cap 104 within which water, dirt, or other materials might otherwise collect.

In one implementation of head covering 102, headband 106 is non-detachably affixed to the bottom circumferential region of cap 104. For example, a non-detachable fastener may be applied at each one of attachment points 202 to non-detachably affix headband 106 to the bottom circumferential region of cap 104. Examples of non-detachable fasteners include but are not limited to stitches of thread, tacks, rivets, clamps, and adhesives. However, these examples are not intended to be limiting and other means for non-detachably affixing headband 106 to the bottom circumferential region of cap 104 may be used. Such an integrated design may require no assembly of head covering 102 by the wearer.

In another implementation of head covering 102, headband 106 is removably attachable to the bottom circumferential region of cap 104. For example, a detachable fastener may be disposed at each one of attachment points 202 to removably attach headband 106 to the bottom circumferential region of cap 104. Examples of detachable fasteners include but are not limited to buttons, snaps, clips, hook and eye material, or magnets. However, these examples are not intended to be limiting and other means for removably attaching headband 106 to the bottom circumferential region of cap 104 may be used. The use of detachable fasteners to removably attach headband 106 to cap 104 may facilitate easy replacement of worn, damaged, or soiled components of cap 104 and/or headband 106, the selection of different size and fit options, the selection of different material options for different environments or situations, and/or the like, in addition to providing the wearer with options for mixing and matching prints, colors, etc., of head covering materials. It is noted that headband 106 may be removably attachable to the bottom circumferential region of cap 104 without using any detachable fasteners. For example, in an embodiment, the attachment is achieved by the contraction of the stretched material of headband 106 against cap 104 and the head of the wearer.

In yet another implementation of head covering 102, at least one of the first stretchable material used to form cap 104 or the second stretchable material used to form headband 106 is a four-way stretchable material. In one particular implementation, the four-way stretchable material comprises a four-way stretchable fabric comprising 86% nylon and 14% elastane, although this is merely one example. The use of a four-way stretchable material beneficially enables cap 104 and/or headband 106 to better encapsulate a variety of different head shapes, hair lengths/volumes, and/or hairdo shapes by permitting "give" in four different directions.

In a further implementation of head covering 102, at least one of the first stretchable material used to form cap 104 or the second stretchable material used to form headband 106 is a water-resistant material. The use of a water-resistant material advantageously serves to protect the wearer's head and hair from water or moisture, which is particularly useful when engaging in watersports or other water-related activities. Furthermore, water-resistant materials that are soft, light and comfortable to wear are generally available at relatively low cost and may present a better design option than certain types of waterproof materials such as plastic and silicon that may have little or no stretch, can feel tight and irritate the scalp, and are not breathable which can lead to heat, discomfort, and/or sweating that disrupts hairstyles.

In a yet further implementation of head covering 102, at least one of the first stretchable material used to form cap 104 or the second stretchable material used to form headband 106 is a breathable material. Breathability is the degree to which a fabric permits air and moisture to pass through it. Breathable materials are those materials that beneficially allow air to flow through them easily. Consequently, the use of such materials to implement the head covering helps to ensure that the head covering will not become too warm or uncomfortable. Furthermore, such materials can speed up sweat evaporation and thus keep the wearer comfortable and dry even when sweating. For the purposes of this document, the term "breathable" refers to a fabric having a moisture vapor transmission rate (MVTR) of at least 5,000 $g/m^2/day$.

In a still further implementation of head covering 102, at least one of the first stretchable material used to form cap 104 or the second stretchable material used to form headband 106 is an ultraviolet (UV) resistant material. The use of a UV-resistant material for cap 104 and/or headband 106 can beneficially protect the wearer's head from harmful UV rays that can cause sunburn, early skin aging, and skin cancer. Furthermore, UV-resistant materials have been shown to better withstand the degradation and fading that can be caused by exposure to UV rays.

In another implementation of head covering 102, at least one of the first stretchable material used to form cap 104 or the second stretchable material used to form headband 106 combines two or more of the aforementioned features—namely, two or more of four-way stretchability, water-resistance, breathability, and UV-resistance.

As further shown in FIGS. 1-5, cap 104 includes a plurality of pleats. In particular, cap 104 includes: a first front pleat 108*a*, a second front pleat 108*b*, a first left pleat 108*c*, a second left pleat 108*d*, a first right pleat 108*e*, a second right pleat 108*f*, a first back pleat 108*g*, a second back pleat 108*h*, a third back pleat 108*i*, and a fourth back pleat 108*j*, (collectively referred to as "pleats 108*a-j*" herein). Each of these pleats is formed by stitching a fold in the first stretchable material of cap 104 at a respective point proximate to circumferential rim 204 of cap 104 and each of these pleats extends from circumferential rim 204 of cap 104 toward a top 110 of cap 104. The inclusion of pleats 108*a-j* helps provide extra volume in cap 104 when needed to accommodate larger volumes of hair or hair dos, while also providing a streamlined appearance when such volume is not needed.

Since the aforementioned pleats are present on all sides of cap 104, additional volume, if needed, is available on all sides of cap 104. This helps facilitate a "one size fits most" aspect of head covering 102. In the implementation shown in FIGS. 1-5, the total number of pleats on the back side of cap 104 (4 pleats) exceeds each of the total number of pleats on the front side of cap 104 (2 pleats), the total number of pleats on the left side of cap 104 (2 pleats), and the total number of pleats on the right side of cap 104 (2 pleats). Such a design is premised on the observation that many or even most long hairstyles are characterized by greater hair volume at the back of the head than on any other side of the head. By providing more pleats on the back of cap 104 than on any other side, head covering 102 advantageously implements pleats where they are likely to be needed most, while permitting a simpler design (e.g., fewer pleats) on the sides of cap 104 where pleats are less likely to be needed. However, it is noted that the implementations described herein are not limited to a particular number or arrangement of pleats on cap 104.

Figure 5:
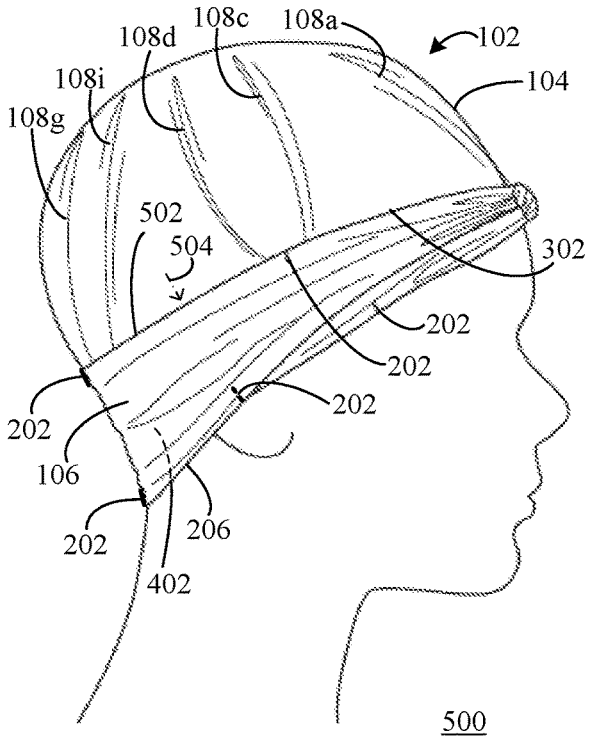
FIG. 5 shows a right-profile perspective view of the head covering of FIG. 1.

As further shown in FIGS. 1-5, each of pleats 108*a-j* is formed such that it extends through one of the spacings between attachment points 202 along top edge 302 of headband 106 at a point that is closer to one of attachment points 202 that forms the spacing than to a center of the spacing. By way of illustration, FIG. 5 highlights a spacing 502 formed by attachment points 202 along top edge 302 of headband 106. A center 504 of spacing 502 is located approximately halfway between attachment points 202 that form spacing 502. As can be seen in FIG. 5, each of pleats 108*d*, 108*g* and 108*i* is formed such that it extends through spacing 502 at a point that is closer to one of attachment points 202 that forms spacing 502 than to center 504 of spacing 502. Such a configuration helps ensure that excess pleat material that is tucked into pocket 402 will be tucked in closer to an attachment point 202, where the clamping force of pocket 402 is expected to be greater, rather than to a midpoint between attachment points 202, where the clamping force of pocket 402 is expected to be less. This helps ensure that tucked in pleat material remains tucked in while head covering is being worn.

Figure 6:
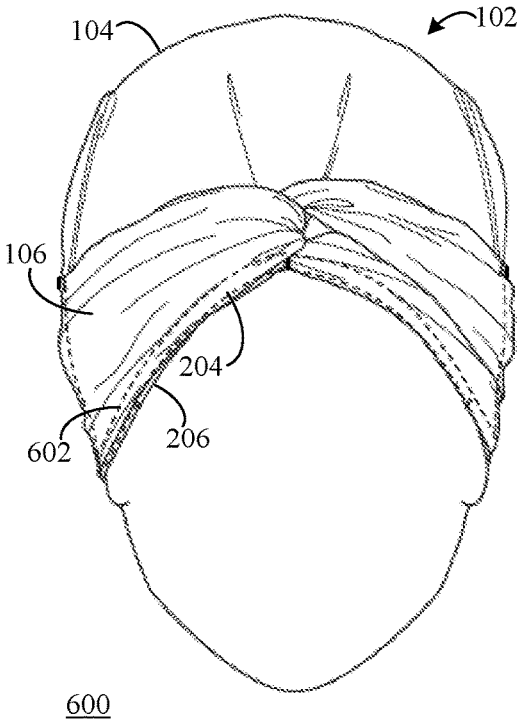
FIG. 6 shows a front perspective view of the head covering of FIG. 1 with certain features of a cap thereof that would otherwise be hidden by a headband thereof shown in outline.
Figure 7:
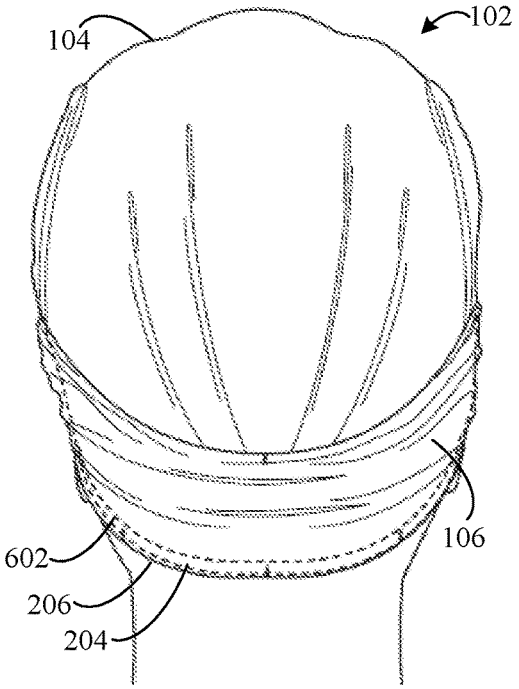
FIG. 7 shows a back perspective view of the head covering of FIG. 1 with certain features of the cap thereof that would otherwise be hidden by the headband thereof shown in outline.
Figure 8:
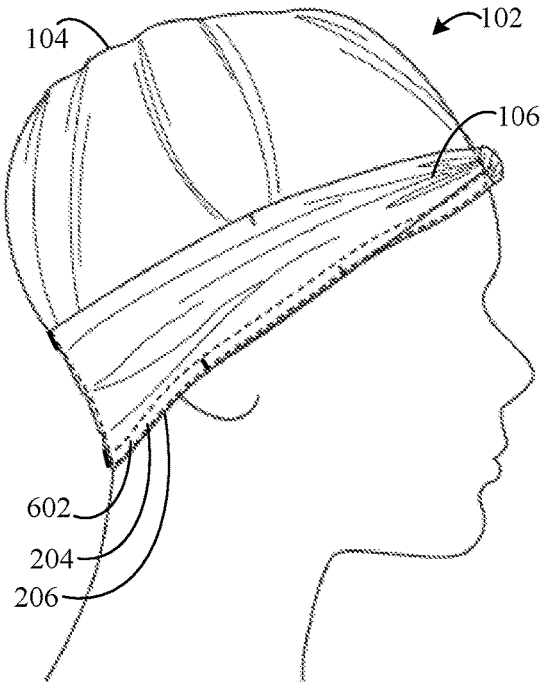
FIG. 8 shows a right-profile perspective view of the head covering of FIG. 1 with certain features of the cap thereof that would otherwise be hidden by the headband thereof shown in outline.

FIGS. 6-8 show a front perspective view 600, a back perspective view 700, and a right-profile perspective view, respectively, of head covering 102 with certain features of cap 104 that would otherwise be hidden by headband 106 shown in outline. As can be seen in FIGS. 6-8, an elastic band 602 is connected to a circumferential rim 204 (or bottom edge) of cap 104. Elastic band 602 is connected to cap 104 such that it circumscribes cap 104 at or proximate to bottom edge 204 of cap 104. As noted above, elastic band 602 helps to more securely hold cap 104 to the head of a wearer and to maintain the hair of the wearer underneath cap 104 and prevent the wearer's hair emerging therefrom. Circumferential rim 204 of cap 104 and bottom edge 206 of headband 106 may be aligned and/or proximate each other as illustrated, where headband 106 approximately covers the bottom circumferential region of cap 104. Elastic band 602 may be formed from any elastic material having a suitable strength, thicknesses, width, and/or the like, for holding cap 104 to the head of a wearer.

Elastic band 602 may be connected to cap 104 by stitches of thread or similar materials, tacks, rivets, clamps, adhesives, and/or the like, although detachable fasteners are also contemplated herein to attach elastic band 602 to cap 104. Depending upon the implementation, elastic band 602 may be attached to the inside of cap 104, the outside of cap 104, or both (i.e., elastic band 602 may be folded over circumferential rim 204 of cap 104 and attached, e.g., via stitching, to both the inside and outside of cap 104). In another implementation, two instances of elastic band 604 may be attached with one each on the inside and the outside of cap 104. In a still further implementation, a hem or collar may be formed along circumferential rim 204 of cap 104 and elastic band 602 may be disposed within said hem or collar. Still other means for attaching elastic band 602 to circumferential rim 204 of cap 104 may be used.

In one implementation of head covering 102, headband 106 is formed from a single piece of the second stretchable material. FIGS. 9-14 illustrate one exemplary manner of assembling headband 106 from such a single piece of the second stretchable material via respective perspective views 900, 1000, 1100, 1200, 1300 and 1400. This description is provided by way of example only, and other methods may be used for forming headband 106.

Figure 9:
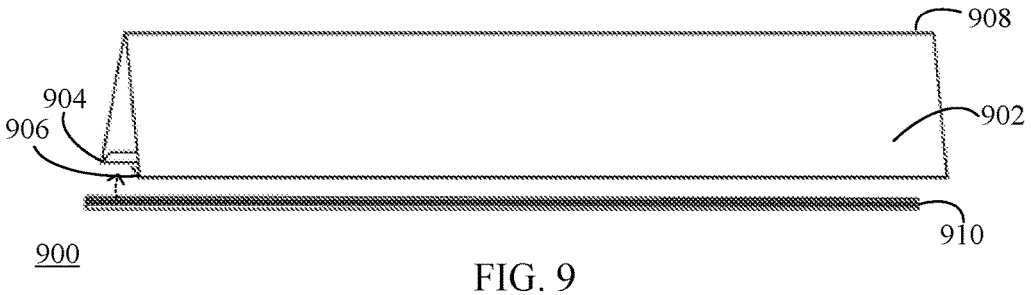
Figure 10:
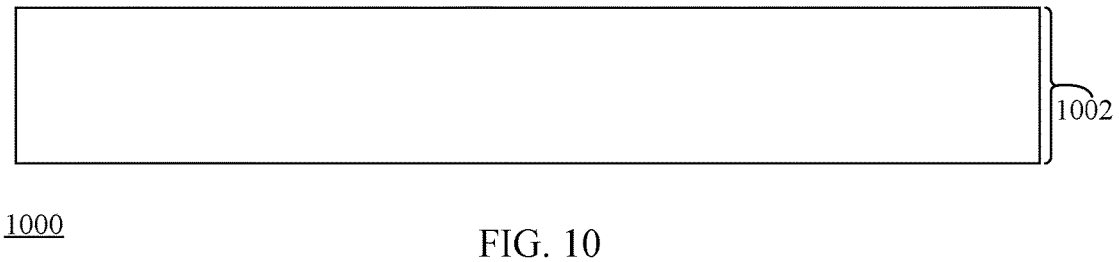

As shown in perspective view 900 of FIG. 9, assembly begins with a rectangular piece 902 of the second stretchable material. Rectangular piece 902 is folded substantially in half lengthwise along a center line 908. A first fold is made along a length of a first long edge of rectangular piece 902 to create a first folded edge 904, and a second fold is made along a length of a second long edge of rectangular piece 902 to create a second folded edge 906. First folded edge 904 and second folded edge 906 are then sewn together to generate sewn band 1002, shown in perspective view 1000 of FIG. 10. The joining of first fold 904 and second fold 906 provides for a cleaner, finished bottom edge of sewn band 1002. The folding in half lengthwise of rectangular piece 902 creates a 2-play sewn band 1002, which provides additional strength to headband 106 for fitting a wearer and durability.

In certain implementations, an elastic band 910 may be sewn into the bottom of sewn band 1002 proximate to first folded edge 904 and second folded edge 906 to improve the fit and security of headband 106. For example, elastic band 910 may be disposed within either of first folded edge 904, second folded edge 906, or disposed between such folded edges.

Figure 11:
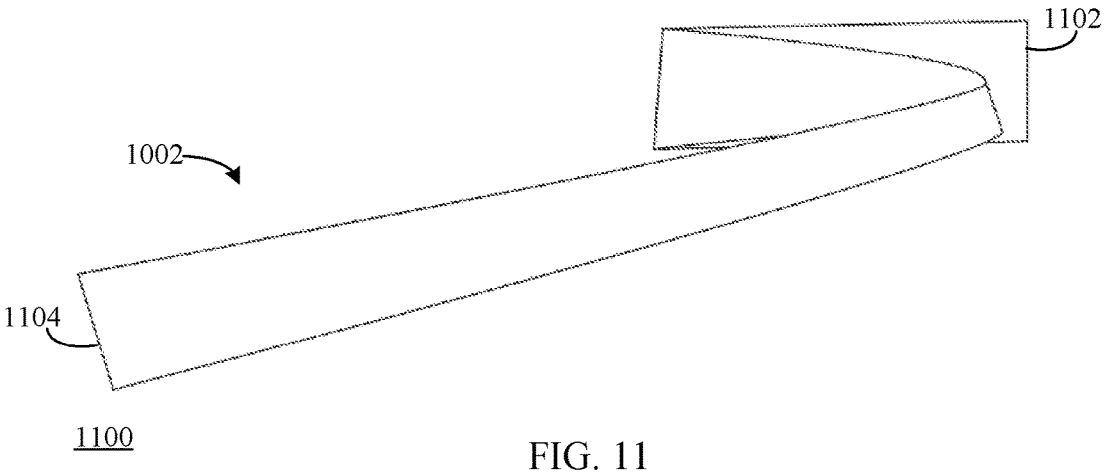
Figure 12:
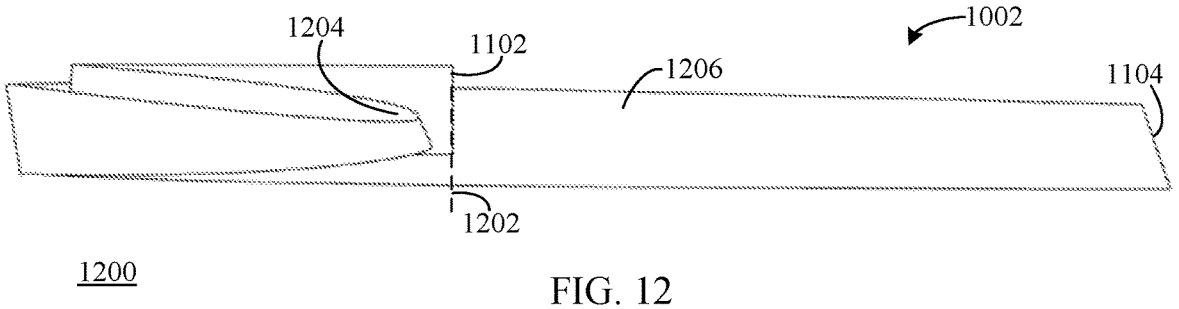
Figure 13:
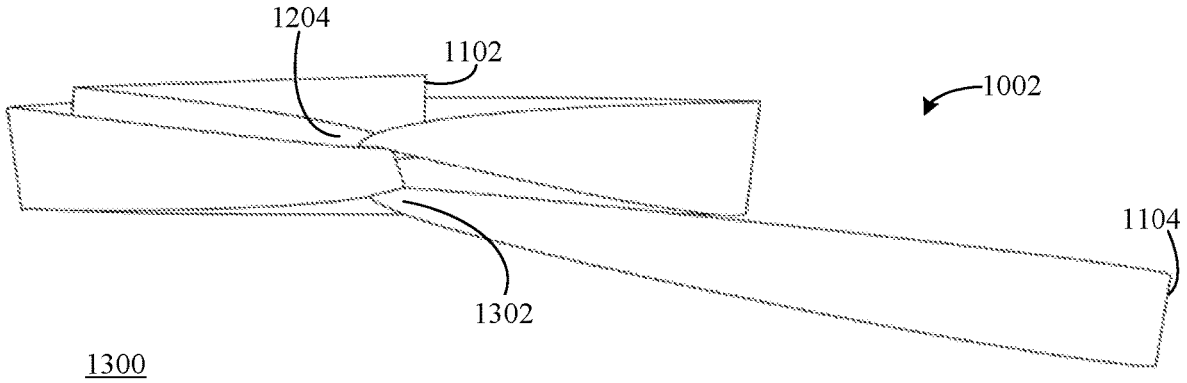
Figure 14:
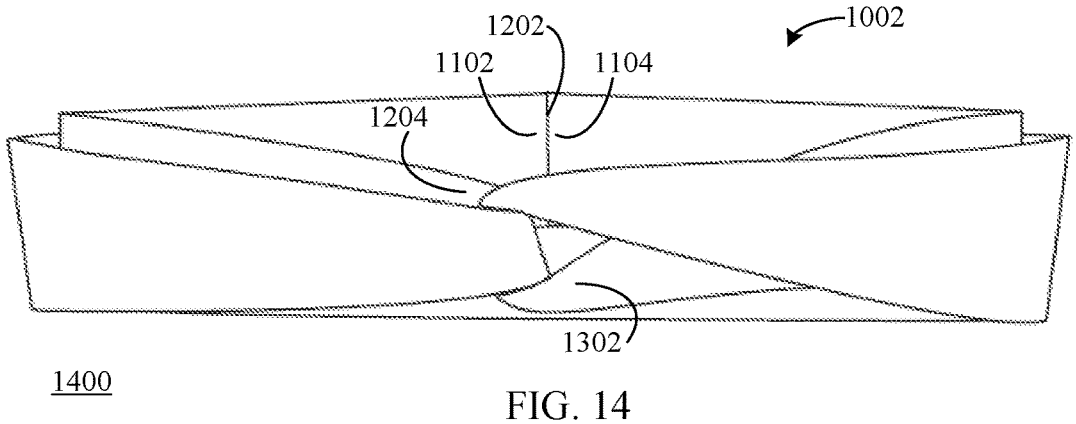

As shown in FIGS. 11 and 12, a first end 1102 of sewn band 1002 is folded substantially to a center 1202 of an inner side 1206 of sewn band 1002, thereby forming a first loop 1204. As shown in FIGS. 13 and 14, a second end 1104 of sewn band 1002 is then folded through first loop 1204 and substantially to center 1202 of inner side 1206 of sewn band 1002, thereby forming a second loop 1302 that is engaged with first loop 1204. First end 1102 and second end 1104 are then coupled (e.g., sewn) to one another and to center 1202 of inner side 1206 of sewn band 1002. This design has a number of benefits, including but not limited to: forming headband 102 with four layers of the second stretchable material, which increases its attachment strength and durability (essentially making it a 4-ply headband), ensuring that only a single stitched seam is required to hold headband 106 together, and ensuring that such single stitched seam is located on the inner side of headband 106 where it is better protected from wear and tear.

FIGS. 15 and 16 shows a lower-front perspective view 1500 and an upper-back perspective view, respectively, of headband 106 for head covering 102 as assembled based on the assembly steps described above in reference to FIGS. 9-14. FIGS. 15 and 16 show headband 106 in a natural material/fabric representation (e.g., showing fabric "gather lines") for exemplary illustration. In lower-front perspective view 1500 for headband 106, an inner seam 1502 of headband 106 is shown. Inner seam 1502 represents a seam at which first end 1102 and second end 1104 of sewn band 1002 are coupled (e.g., sewn) to one another and to center 1202 of inner side 1206 of sewn band 1002, as previously described. In FIG. 16, inner seam 1502 of headband 106 is shown from the outside of headband 106 and is represented as a dashed line because inner seam 1502 is obscured in upper-back perspective view 1600.

FIG. 17 illustrates in the form of a flowchart 1700 the exemplary process of assembling headband 106 from a single piece of the second stretchable material as described above in reference to FIGS. 9-14. As shown in FIG. 17, flowchart 1700 begins at step 1702 in which a single piece of the second stretchable material is folded to form an elongated piece. This step corresponds to the folding of piece 902 to form sewn band 1002 as described above in reference to FIGS. 9 and 10.

At step 1704, a first loop is formed by folding a first end of the elongated piece substantially to a center of an inner side of the elongated piece. This step corresponds to the forming of first loop 1204 by folding first end 1102 of sewn band 1002 substantially to center 1202 of inner side 1206 of sewn band 1002 as described above in reference to FIGS. 11 and 12.

At step 1706, a second loop is formed by folding a second end of the elongated piece through the first loop and substantially to the center of the inner side of the elongated piece. This step corresponds to the forming of second loop 1302 by folding second end 1104 of sewn band 1002 through first loop 1204 and substantially to center 1202 of inner side 1206 of sewn band 1002 as described above in reference to FIGS. 13 and 14.

At step 1708, the first and second ends are coupled to one another and to the center of the inner side of the elongated piece. This step corresponds to the coupling of first end 1102 and second end 1104 of sewn band 1002 to one another and to center 1202 of inner side 1206 of sewn band 1002 as described above in reference to FIG. 14.

FIG. 18 shows attachment configurations 1800 in a front perspective view and a back perspective of cap 104 for head covering 102 with respect to headband 106, in accordance with an example implementation. Attachment configurations 1800 in FIG. 18 include a configuration 1802, a configuration 1804, and a configuration 1806.

As shown in configuration 1802, a non-detachable fastener (e.g., a tack) is affixed at attachment point 202 at the front of cap 104 and headband 106 at the bottom edge of each. This non-detachable fastener may be affixed through material of cap 104 and through both loop ends of headband 106.

As shown in configuration 1804, three non-detachable fasteners (e.g., tacks) are affixed at attachment points 202 at the left of cap 104 and headband 106 with two at the bottom edge of each and one at the top edge of headband 106. As with configuration 1802, the non-detachable fasteners shown in configuration 1804 may be affixed through material of cap 104 and through both layers of headband 106. A similar configuration may be used for the right side of head covering 102 (not shown for brevity).

As shown in configuration 1806, three non-detachable fasteners (e.g., tacks) are affixed at attachment points 202 at the back of cap 104 and headband 106 with three at the bottom edge of each and one at the top edge of headband 106. As with configuration 1802 and configuration 1804, the non-detachable fasteners shown in configuration 1806 may be affixed through material of cap 104 and through both layers of headband 106.

FIG. 19 shows a multi-perspective view 1900 of head covering 102 with tucking of excess cap material 1902, in accordance with an example implementation. Multi-perspective view 1900 includes a view 1904 that shows two perspectives of head covering 102: a front view with cap 104 shown through a transparent representation of headband 106; and a left side view with cap 104 and headband 106 shown as similarly depicted in configuration 1804 of FIG. 18. View 1904 illustrates excess material 1902 of cap 104 that is present after a wearer dons head covering 102. When a wearer dons head covering 102, varying amounts of excess material 1902 may be present.

Multi-perspective view 1900 also includes a view 1906 and a view 1908. View 1906 shows a wearer after donning head covering 102 with excess material 1902 thereof protruding out and above headband 106. The wearer is enabled to tuck (shown as three (3) arrows with dashed-dotted lines pointed down toward headband 106) excess material 1902 into pocket 402 of head covering 102. The tucking shown in the illustrated example corresponds to the right, back, and left sides of head covering 102.

Pocket 402 of head covering 102 is configured to hold and store tucked excess material 1902 therein. This is shown in view 1908 where only material of head covering 102 that is necessary to conform to the head and hair of the wearer is visible, and excess material 1902 is not shown as it is tucked into pocket 402 of head covering 102.

Accordingly, head covering 102 is configured to accommodate wearers with different types of hair styles and different volumes of hair. In this context, FIGS. 20 and 21 will now be described and show the same head covering, i.e., head covering 102, as worn by different wearers with different hair volumes and styles.

FIG. 20 shows a multi-perspective view 2000 of head covering 102 with tucking of excess cap material for a wearer with large hair volume. Multi-perspective view 2000 includes a view 2002, a view 2004, a view 2008, and a view 2012. View 2002 is a front view of a wearer having a large hair volume 2006 that is styled as a bun (or the like) and gathered at the top and back of the wearer's head. View 2004 is a back view of the wearer having large hair volume 2006 and shows large hair volume 2006 with respect to the head of the wearer.

View 2008 shows the wearer in view 2002 and view 2004 after having donned head covering 102. In some cases, because of large hair volume 2006 of the wearer, a majority or all of the excess material of the cap portion may be utilized to cover the wearer's hair—this is illustrated in view 2008 by a front material amount 2010 representing most or all of the excess material of the front of the cap for head covering 102. In these cases where most of the excess material is utilized, a relatively small remainder amount of excess material of cap 104 is tucked into pocket 402 of head covering 102.

Similarly, view 2012 shows the wearer in view 2002 and view 2004 after having donned head covering 102. Again, because of large hair volume 2006 of the wearer, a majority or all of the excess material of cap 104 may be utilized to cover the wearer's hair—this is illustrated in view 2012 by a back material amount 2014 representing most or all of the excess material of the back of cap 104 for head covering 102. In these cases where most the excess material is utilized, a relatively small remainder amount of excess material of cap 104 is tucked into pocket 402 of head covering 102. Additionally, the strategic placement and configuration of pleats for head covering 102 enable the accommodation of large hair volume 2006 as noted above (e.g., pleats **108*a-j*** as described herein).

In contrast, FIG. 21 shows a multi-perspective view 2100 of head covering 102 with tucking of excess cap material for a wearer with small hair volume. Multi-perspective view 2100 includes a view 2102, a view 2104, a view 2105, a view 2108, and a view 2112. View 2102 is a front view of a wearer having a small hair volume 2106 that lacks a gathering of hair around the head of the wearer. View 2104 is a back view of the wearer having small hair volume 2106 and shows the lack of hair gathered at the head of the wearer.

View 2105 shows the wearer in view 2102 and view 2104 after having donned head covering 102 and prior to tucking excess material 1902 (as in FIG. 19) of cap 104 of head covering 102. That is, small hair volume 2106 requires less material of cap 104 of head covering 102 for accommodation, and therefore, excess material 1902 of cap 104 is loose and free. However, as described herein, head covering 102 enables excess material 1902 to be tucked into and stored in pocket 402 of head covering 102 so that cap 104 better conforms to and holds the hair style of the wearer.

For instance, view 2108 shows the wearer in view 2102 and view 2104 after having donned head covering 102 and tucked excess material 1902 of cap 104 into pocket 402 of head covering 102. In this case, because of small hair volume 2106 of the wearer, little or none of excess material 1902 of cap 104 may be utilized to cover and conform to the wearer's hair—this is illustrated in view 2108 by a front material amount 2110 representing relatively less of excess material 1902 of the front of cap 104 for head covering 102 being needed than is shown for front material amount 2010 in FIG. 20 (for large hair volume 2006).

Similarly, view 2112 shows the wearer in view 2102 and view 2104 after having donned head covering 102 and tucked excess material 1902 of cap 104 into pocket 204 of head covering 102. Again, because of small hair volume 2106 of the wearer, little or none of excess material 1902 of cap 104 may be utilized to cover and conform to the wearer's hair—this is illustrated in view 2112 by a back material amount 2114 representing relatively less of excess material 1902 of the back of cap 104 for head covering 102 being needed than is shown for back material amount 2014 in FIG. 20 (for large hair volume 2006).

Finally, FIGS. 22A and 22B will be described as showing tucking of excess material for cap 104 of head covering 102 by a wearer with a small hair volume.

FIG. 22A shows a single-perspective view 2200A of head covering 102 with tucking of excess cap material by a wearer. Single-perspective view 2200A includes three front views of a wearer that is wearing head covering 102: a view 2202, a view 2204, and a view 2206.

View 2202 shows a wearer after donning head covering 102 with excess material 1902 thereof protruding out and above headband 106, e.g., due to a small hair volume. The wearer is enabled to tuck excess material 1902 into pocket 402 of head covering 102 as shown in view 2204. In view 2204, the wearer tucks excess material 1902 into pocket 402 via openings formed as described above. In view 2206, the wearer has tucked excess material 1902 into pocket 402, which is configured to receive and securely store tucked excess material 1902 therein, allowing head covering 102 to conform to the head and hairstyle of the wearer.

FIG. 22B shows a multi-perspective view 2200B of head covering 102 from FIG. 22A with tucking of excess cap material by a wearer, in accordance with an example embodiment. Multi-perspective view 2200B includes four views of a wearer that is wearing head covering 102: a view 2208, a view 2210, a view 2212, and a view 2214. View 2208 is a right-side view that shows the wearer tucking excess material 1902 into pocket 402 of head covering 102, and view 2210 is a right-side view that shows how the wearer has tucked excess material 1902 into pocket 402. Similarly, view 2212 is a back view that shows the wearer tucking excess material 1902 into pocket 402 of head covering 102, and view 2214 is a back view that shows how the wearer has tucked excess material 1902 into pocket 402.

III. Conclusion

While various embodiments have been described above, it should be understood that they have been presented by way of example only, and not limitation. It will be apparent to persons skilled in the relevant art(s) that various changes in form and details can be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A head covering, including:

a cap formed from a first stretchable material and shaped to encompass a top of a human head, the cap comprising opposing front and back sides, opposing right and left sides, and a top to be positioned adjacent to the top of the human head, the front side having a first center and the back side having a second center;

an elastic band connected to a circumferential rim of the cap; and a headband formed from a second stretchable material and arranged around a bottom circumferential region of the cap, the headband being non-detachably affixed to the bottom circumferential region of the cap at a plurality of attachment points spaced along a top edge of the headband and a bottom edge of the headband, affixing of the headband to the cap forming a pocket therebetween;

wherein spacings between the plurality of attachment points along the top edge of the headband form openings that provide access to the pocket, to receive via the openings excess material of the cap for storage therein, wherein the plurality of attachment points along the top edge comprise an attachment point positioned proximate the second center, an attachment point positioned on the left side, and an attachment point positioned on the right side, wherein the plurality of attachment points along the bottom edge comprise an attachment point positioned proximate to the second center, at least two attachment points positioned on the left side, at least two attachment points positioned on the right side, and an attachment point positioned proximate to the first center, and wherein the cap further comprises a plurality of pleats, the plurality of pleats comprise at least four pleats positioned on the back side, at least two pleats positioned on the left side, at least two pleats positioned on the right side, and at least two pleats positioned on the front side of the cap, the plurality of pleats formed by stitching a fold in the first stretchable material at a respective point proximate to the circumferential rim of the cap, and extending from the circumferential rim of the cap toward a top of the cap.

2. The head covering of claim 1, wherein at least one of the first stretchable material or the second stretchable material comprises at least one of:

a four-way stretchable material;

a water-resistant material;

a breathable material; or an ultraviolet (UV) resistant material.

3. The head covering of claim 1, wherein the headband comprises:

a first loop formed by folding a first end of an elongated piece of the second stretchable material substantially to a center of an inner side of the elongated piece;

a second loop formed by folding a second end of the elongated piece through the first loop and substantially to the center of the inner side of the elongated piece; and a coupling connecting the first and second ends to one another and to the center of the inner side of the elongated piece.

4. The head covering of claim 1, wherein the first stretchable material and the second stretchable material are a same stretchable material.

5. The head covering of claim 1, wherein each of the pleats of the plurality of pleats positioned on the back side, the left side, and the right side is formed such that it extends through one of the spacings at a point that is closer to one of the attachment points of the plurality of attachment points that forms the spacing than to a center of the spacing such that excess material that is tucked into the pocket will be tucked closer to one of the attachment points of the plurality of attachment points where the clamping force is greater than at the center of the spacing.

6. The head covering of claim 1, wherein the headband is non-detachably affixed to the bottom circumferential region of the cap by one or more of:

stitches of thread;

tacks;

rivets;

clamps; or an adhesive.

7. A head covering, including:

a cap formed from a first stretchable material and shaped to encompass a top of a human head, the cap comprising opposing front and back sides, opposing right and left sides, and a top to be positioned adjacent to the top of the human head, the front side having a first center and the back side having a second center;

an elastic band connected to a circumferential rim of the cap; and a headband formed from a second stretchable material and arranged around a bottom circumferential region of the cap, the headband being removably coupled to the bottom region of the cap by detachable fasteners at a plurality of attachment points spaced along the top edge of the headband and the bottom edge of the headband, affixing of the headband to the cap forming a pocket therebetween;

wherein spacings between the plurality of attachment points along the top edge of the headband form openings that provide access to the pocket to receive via the openings excess material of the cap for storage therein, wherein the plurality of attachment points along the top edge comprise an attachment point positioned proximate the second center, an attachment point positioned on the left side, and an attachment point positioned on the right side, wherein the plurality of attachment points along the bottom edge comprise an attachment point positioned proximate to the second center, at least two attachment points positioned on the left side, at least two attachment points positioned on the right side, and an attachment point positioned proximate to the first center, and wherein the cap further comprises a plurality of pleats, the plurality of pleats comprise at least four pleats positioned on the back side, at least two pleats positioned on the left side, at least two pleats positioned on the right side, and at least two pleats positioned on the front side of the cap, the plurality of pleats formed by stitching a fold in the first stretchable material at a respective point proximate to the circumferential rim of the cap and extending from the circumferential rim of the cap toward a top of the cap.

8. The head covering of claim 7, wherein each of the pleats of the plurality of pleats positioned on the back side, the left side, and the right side is formed such that it extends through one of the spacings at a point that is closer to one of the attachment points of the plurality of attachment points that forms the spacing than to a center of the spacing such that excess material that is tucked into the pocket will be tucked closer to one of the attachment points of the plurality of attachment points where the clamping force is greater than at the center of the spacing.

9. The head covering of claim 7, wherein at least one of the first stretchable material and the second stretchable material comprises at least one of:

a four-way stretchable material;

a water-resistant material;

a breathable material; or an ultraviolet (UV) resistant material.

10. The head covering of claim 7, wherein the detachable fasteners comprise one or more of:

buttons;

snaps;

clips;

hook and eye material; or magnets.

11. The head covering of claim 7, wherein the first stretchable material and the second stretchable material are a same stretchable material.

12. The head covering of claim 7, wherein said elongated piece is formed by folding a piece of the second stretch material in half lengthwise.

13. The head covering of claim 7, wherein said headband comprises a four-ply headband.

14. The head covering of claim 7, wherein the headband comprises:

a first loop formed by folding a first end of an elongated piece of the second stretchable material substantially to a center of an inner side of the elongated piece;

a second loop formed by folding a second end of the elongated piece through the first loop and substantially to the center of the inner side of the elongated piece; and a coupling connecting the first and second ends to one another and to the center of the inner side of the elongated piece.

15. A head covering that includes:

a cap formed from a first four-way stretchable material and shaped to encompass a top of a human head;

an elastic band connected to a circumferential rim of the cap; and a headband formed from a second stretchable material formed in a loop having an interior portion and attached to a bottom circumferential region of the cap at a plurality of attachment points spaced along a top edge of the headband and a bottom edge of the headband, affixing of the headband to the cap forming a pocket that circumscribes the bottom circumferential region of the cap covered by the headband and is bounded by the interior portion of the headband and the bottom circumferential region of the cap covered by the headband, wherein spacings between the plurality of attachment points along the top edge of the headband form openings that provide access to the pocket to receive via the openings excess material of the cap for storage therein, wherein the plurality of attachment points along the top edge comprise an attachment point positioned proximate the second center, an attachment point positioned on the left side, and an attachment point positioned on the right side, wherein the plurality of attachment points along the bottom edge comprise an attachment point positioned proximate to the second center, at least two attachment points positioned on the left side, at least two attachment points positioned on the right side, and an attachment point positioned proximate to the first center, and wherein the cap further comprises a plurality of pleats, the plurality of pleats comprise at least four pleats positioned on the back side. at least two pleats positioned on the left side, at least two pleats positioned on the right side, and at least two pleats positioned on the front side of the cap, the plurality of pleats formed by stitching a fold in the first stretchable material at a respective point proximate to the circumferential rim of the cap and extending from the circumferential rim of the cap toward a top of the cap.

16. The head covering of claim 15, wherein at least one of the first stretchable material and the second stretchable material comprises at least one of:

a four-way stretchable material;

a water-resistant material;

a breathable material; or an ultraviolet (UV) resistant material.

17. The head covering of claim 15, wherein the headband comprises:

a first loop formed by folding a first end of an elongated piece of the second stretchable material substantially to a center of an inner side of the elongated piece;

a second loop formed by folding a second end of the elongated piece through the first loop and substantially to the center of the inner side of the elongated piece; and a coupling connecting the first and second ends to one another and to the center of the inner side of the elongated piece.

18. The head covering of claim 17, wherein said coupling connecting the first and second ends to one another and to the center of the inner side of the elongated piece comprises a sewn coupling.

19. The head covering of claim 15, wherein the first stretchable material and the second stretchable material are a same stretchable material.

20. The head covering of claim 15, wherein the headband is non-detachably affixed to the bottom circumferential region of the cap by one or more of:

stitches of thread;

tacks;

rivets;

clamps; or an adhesive.

21. The head covering of claim 15, wherein the headband is removably attached to the bottom circumferential region of the cap by one or more of:

buttons;

snaps;

clips;

hook and eye material; or magnets.

22. The head covering of claim 15, wherein the pocket circumscribes the bottom circumferential region of the cap.

23. The head covering of claim 15, wherein each of the pleats of the plurality of pleats positioned on the back side, the left side, and the right side is formed such that it extends through one of the spacings at a point that is closer to one of the attachment points of the plurality of attachment points that forms the spacing than to a center of the spacing such that excess material that is tucked into the pocket will be tucked closer to one of the attachment points of the plurality of attachment points where the clamping force is greater than at the center of the spacing.

24. The head covering of claim 15, wherein said headband comprises a four-ply headband, and affixing of the four-ply headband to the cap provides at least five layers of protection.

* * * * *